US008448439B2

(12) United States Patent
Namba et al.

(10) Patent No.: US 8,448,439 B2
(45) Date of Patent: May 28, 2013

(54) ELECTRIC POWER PLANT, AND METHOD FOR RUNNING ELECTRIC POWER PLANT

(75) Inventors: Koji Namba, Mito (JP); Shigeo Hatamiya, Hitachi (JP); Fumio Takahashi, Hitachi (JP); Koji Nishida, Hitachiota (JP); Susumu Nakano, Hitachi (JP); Takanori Shibata, Hitachinaka (JP)

(73) Assignee: Hitachi-GE Nuclear Energy, Ltd., Hitach-shi (JP)

( * ) Notice: Subject to any disclaimer, the term of this patent is extended or adjusted under 35 U.S.C. 154(b) by 458 days.

(21) Appl. No.: 12/920,505

(22) PCT Filed: Jan. 30, 2009

(86) PCT No.: PCT/JP2009/000359

§ 371 (c)(1), (2), (4) Date: Sep. 1, 2010

(87) PCT Pub. No.: WO2010/086898

PCT Pub. Date: Aug. 5, 2010

(65) Prior Publication Data

US 2011/0005225 A1 Jan. 13, 2011

(51) Int. Cl.

| | |
|---|---|
| ***F01K 3/00*** | (2006.01) |
| ***F01K 13/02*** | (2006.01) |
| ***F01K 13/00*** | (2006.01) |
| ***F01K 17/00*** | (2006.01) |
| ***F01K 7/34*** | (2006.01) |

(52) U.S. Cl.
USPC ..... 60/678; 60/652; 60/677; 60/644.1

(58) Field of Classification Search
USPC ..... 60/645–681
See application file for complete search history.

(56) References Cited

U.S. PATENT DOCUMENTS 3,842,605 A * 10/1974 Tegtmeyer ..... 60/678
4,047,386 A * 9/1977 Frondorf ..... 60/654

(Continued)

FOREIGN PATENT DOCUMENTS

DE 1 043 348 B 11/1958
JP 63-50611 A 3/1988

(Continued)

OTHER PUBLICATIONS

International Search Report including English translation dated Mar. 3, 2009 (Four (4) pages).

*Primary Examiner* — Kenneth Bomberg
*Assistant Examiner* — Christopher Jetton
(74) *Attorney, Agent, or Firm* — Crowell & Moring LLP

(57) ABSTRACT

An electric power plant supplies steam generated to a high-pressure turbine and a low-pressure turbine. The steam discharged from the low-pressure turbine is condensed with a condenser. Water generated with the condenser is heated with a low-pressure feed water heater and a high-pressure feed water heater. The steam extracted from the high-pressure turbine is supplied to the high-pressure feed water heater. The steam extracted from the low-pressure turbine is compressed with a steam compressor, and the steam whose temperature has been increased is then supplied to the high-pressure feed water heater. The feed water is heated in the high-pressure feed water heater by the steam extracted from the high-pressure turbine and the steam compressed with the steam compressor. Because the feed water is heated by the extracted steam and the compressed steam in the high-pressure feed water heater, the amount of power consumed by the steam compressor can be reduced.

18 Claims, 14 Drawing Sheets

U.S. PATENT DOCUMENTS

| | | | | |
|---|---|---|---|---|
| 4,748,815 | A * | 6/1988 | Junior et al. | 60/692 |
| 8,091,361 | B1 * | 1/2012 | Lang | 60/654 |

FOREIGN PATENT DOCUMENTS

| | | | |
|---|---|---|---|
| JP | 1-123001 | A | 5/1989 |
| JP | 4-116203 | A | 4/1992 |
| JP | 5-65808 | A | 3/1993 |
| JP | 11-173110 | A | 6/1999 |

* cited by examiner

CONVENTIONAL EXAMPLE

IMPROVED PLAN

ELECTRIC POWER PLANT, AND METHOD FOR RUNNING ELECTRIC POWER PLANT

BACKGROUND OF THE INVENTION

1. Field of the Invention

The present invention relates to an electric power plant and a method for running the electric power plant, and in particular, relates to an electric power plant and a method for running the electric power plant suitable for applying to nuclear power plants and thermal power plants.

2. Description of the Related Art

In order to increase thermal efficiency in the power plant (power station), a thermal power plant which utilizes a steam heat pump using a compressor has been proposed. An example of this thermal power plant is disclosed in Japanese utility model application publication No. Hei 1 (1989)-123001. The proposed thermal power plant sequentially supplies steam generated by the boiler to the high-pressure turbine, the medium-pressure turbine, and the low-pressure turbine, rotating the generator connected to the rotational axis of those turbines, thereby generating electric power. Steam discharged from the low-pressure turbine is condensed by the condenser and becomes water. This water is supplied to the boiler as feed water through the feed water pipe. Feed water is heated by four-stage feed water heaters while the water runs through the feed water pipe, increasing the water temperature. Steam extracted from the condenser is compressed by the compressor, increasing temperature, and the compressed steam is extracted from a plurality of locations longitudinally along the axis of the compressor and supplied to each feed water heater. Feed water is heated by the steam that has been supplied to each feed water heater. Steam becomes condensed water by each feed water heater, and the condensed water is supplied as feed water. Furthermore, the steam compressor becomes overheated because internal entropy increases due to adiabatic compression of steam. Accordingly, to prevent the steam compressor from overheating and conserve the required electric power, a mist of condensed water is sprayed within the above steam compressor.

Furthermore, Japanese Patent Laid-open No. Hei 5(1993)-65808 discloses a combined heat steam turbine plant. This combined heat steam turbine plant supplies steam generated by the boiler to the turbine, rotating the generator, generating electric power, and steam discharged from the turbine is supplied to the high-pressure process steam supply destination and the low-pressure process steam supply destination. Steam supplied to the high-pressure process steam supply destination has been compressed by a compressor after the steam was discharged from the turbine.

Meanwhile, Japanese utility model application publication No. Hei 1(1989)-123001 describes a thermal power plant wherein steam supplied from a condenser is compressed by one compressor, and the compressed steam is supplied from a plurality of locations longitudinally along the axis of the compressor to four feed water heaters.

Patent literature 1: Japanese Patent Laid-open No. Hei 5(1993)-65808; and

Patent literature 2: Japanese unexamined utility model application publication No. Hei 1(1989)-123001.

SUMMARY OF THE INVENTION

Generally, in order to increase power output in the existing power plant, it is necessary to increase the feed water flow rate and the main steam flow rate in almost proportion to the degree of increase in power output. It is possible to ensure a sufficient design margin for the increase in the feed water flow rate and the main steam flow rate according to the increase in power output by altering and replacing equipment as necessary. However, when increasing power output, thermal efficiency in the power plant decreases; accordingly, it is desirable that a decrease in thermal efficiency in the power plant be prevented while the power output increases. To do so, it is considered that feed water temperature needs to be higher.

Therefore, the inventors discussed and studied the method described in Japanese utility model application publication No. Hei 1(1989)-123001 wherein steam compressed by the compressor and extracted therefrom is supplied to each of four feed water heaters, thereby heating feed water. The inventors then found problems in that the compressor needs to be large and the amount of electric power consumed by driving the compressor is also large in order to supply compressed air to four feed water heaters by the use of one compressor as in the thermal power plant described in Japanese utility model application publication No. Hei 1(1989)-123001. Electric power generated by a thermal power plant equipped with a compressor is used to drive the compressor; however, the consumption of a large amount of electric power by the compressor results in reducing the efficiency in the thermal power plant.

In view of the foregoing, it is an objective of the present invention to provide an electric power plant and a method for running the electric power plant capable of increasing thermal efficiency in the plant when increasing the power output.

In accordance with an aspect of the present invention, there is a characteristic in the present invention in which an electric power plant includes: a main steam system equipped with a main steam pipe connected to a steam generating apparatus to direct steam, a first turbine to which the steam is sequentially supplied through the main steam pipe, and a second turbine having a lower pressure than the first turbine; a feed water heater provided for a feed water pipe that directs feed water generated by condensing the steam with a condenser to the steam generating apparatus; a steam compression apparatus for compressing the steam; a first pipe which is not provided with a steam compression apparatus and directs the steam extracted from a first location of the main steam system to the feed water heater; and a second pipe that is provided with the steam compression apparatus and supplies the steam extracted from a second location of the main steam system located downstream of the first location to the feed water heater.

In the feed water heater, because feed water is heated by steam directed by the first pipe and steam compressed with the steam compression apparatus and directed by the second pipe, it is possible to limit the increase by a small degree in temperature of steam compressed with the steam compression apparatus. Therefore, it is possible to reduce thermal energy consumed by driving the steam compression apparatus, thereby making it possible to increase thermal efficiency in the power plant during the operation to increase power output in the power plant.

In accordance with another aspect of the present invention, there is a characteristic in the present invention in which an electric power plant includes: a main steam system equipped with a main steam pipe connected to a steam generating apparatus to direct steam, a first turbine to which the steam is sequentially supplied by the main steam pipe, and a second turbine having a lower pressure than the first turbine; a plurality of feed water heaters provided for a feed water pipe that directs feed water generated by condensing the steam with a condenser to the steam generating apparatus; first and second steam compressors that are driven by a drive apparatus and sequentially compress the steam; a first pipe which is provided with the first and second steam compressors located in series and directs the steam extracted from a certain location of the main steam system to a feed water heater. Furthermore, a second pipe is provided which directs a portion of the steam discharged from the first steam compressor, of the first and second steam compressors, located upstream of steam flow to another feed water heater disposed upstream of the feed water heater.

ADVANTAGES OF THE INVENTION

According to the present invention, it is possible to provide an electric power plant and a method for running the electric power plant capable of increasing thermal efficiency in the plant when increasing the power output.

BRIEF DESCRIPTION OF THE DRAWINGS

FIG. 3(A) is a schematic configuration diagram of the conventional power plant; FIG. 3(B) is the T-S diagram of the conventional power plant shown in FIG. 3(A); FIG. 3(C) is a schematic configuration diagram of the power plant according to an improved plan showing one aspect of the present invention; and FIG. 3(D) is the T-S diagram of the power plant according to the improved plan shown in FIG. 3(C).

LEGEND

Figure 1:
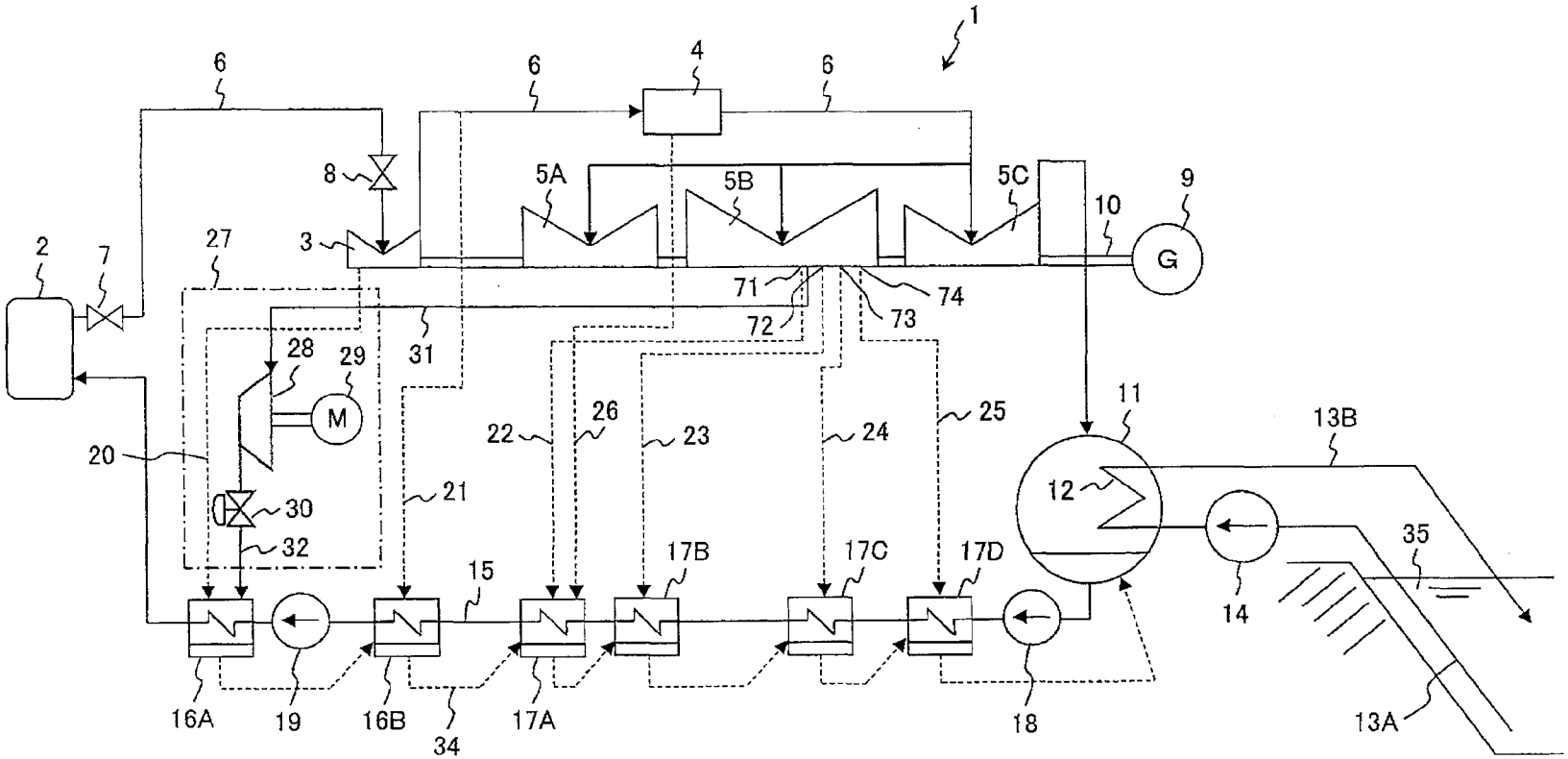
FIG. 1 is a configuration diagram of a boiling water reactor (BWR) nuclear power plant according to a first embodiment which is a preferred embodiment of the present invention.

1, 1A, 1B, 1C, 1D, 1E, 1F, 1K, and 1L: Boiling water reactor (BWR) nuclear power plant;
1G: Pressurized water reactor (PWR) nuclear power plant;
1H: Fast breeder reactor (FBR) nuclear power plant;
1J: Combined thermal power plant;
2 and 2A: Nuclear reactor;
3: High-pressure turbine;
4: Moisture separator;
5A, 5B, and 5C: Low-pressure turbine;
6: Main steam pipe;
11: Condenser;
15: Feed water pipe;
16A: First high-pressure feed water heater;
16B: Second high-pressure feed water heater;
17A: Third low-pressure feed water heater;
17B: Fourth low-pressure feed water heater;
17C: Fifth low-pressure feed water heater;
17D: Sixth low-pressure feed water heater;
19: Feed water pump;
20, 21, 22, 23, 24, and 25: Extraction pipe;
26: Drainage pipe;
27, 27A, 27B, 27C, 27D, 27E, and 27F: Steam compression apparatus;
28, 28A, and 28B: Steam compressor;
29: Drive apparatus;
37 and 38: Turbine;
45, 54, and 57: Steam generator;
50: Fast breeder reactor (FBR);
59: Gas turbine; and
60: Combustor.

DETAILED DESCRIPTION OF THE PREFERRED EMBODIMENTS

As stated above, the inventors discussed and studied in detail the thermal power plant described in Japanese utility model application publication No. Hei 1(1989)-123001. Consequently, the inventors found the problems in that the compressor of Hei 1(1989)-123001 needed to be large and the amount of electric power consumed by the compressor was also large. Since electric power generated by the thermal power plant equipped with a compressor is used to drive the compressor, the consumption of a large amount of electric power by the compressor results in reducing the efficiency in the thermal power plant.

In order to solve the above problems, the inventors have made various studies. Consequently, the inventors found the means for solving the problems. The means is that in a power plant, for example, in a thermal power plant, steam extracted from a steam system, such as a turbine or the like, is supplied to a feed water heater which heats feed water, and simultaneously, steam extracted from a location downstream of the extraction point of the former steam is compressed by a compressor and then supplied to the feed water heater (hereinafter, this means is referred to as an improved plan). This improved plan indicates a concept of the present invention. In the improved plan, steam extracted from the steam system, such as a turbine or the like, is supplied to the feed water heater which heats feed water without the steam passing through the compressor, and simultaneously, steam compressed with the compressor is also supplied to that feed water heater. Accordingly, the amount of increase in steam temperature by steam being compressed with a compressor can be made smaller than the amount of increase in steam temperature by steam being compressed with a compressor as required in the thermal power plant described in Japanese utility model application publication No. Hei 1(1989)-123001. The amount of plant service power consumed by driving the compressor used in the power plant according to the improved plan can be smaller than the amount of plant service power consumed by driving the compressor used in the power plant described in Japanese utility model application publication No. Hei 1(1989)-123001. Consequently, thermal efficiency in the power plant according to the improved plan can be increased.

Thermodynamic cycle of the conventional power plant and that of the power plant according to the improved plan will be described with reference to FIGS. 3(A) to 3(D).

Figure 3:
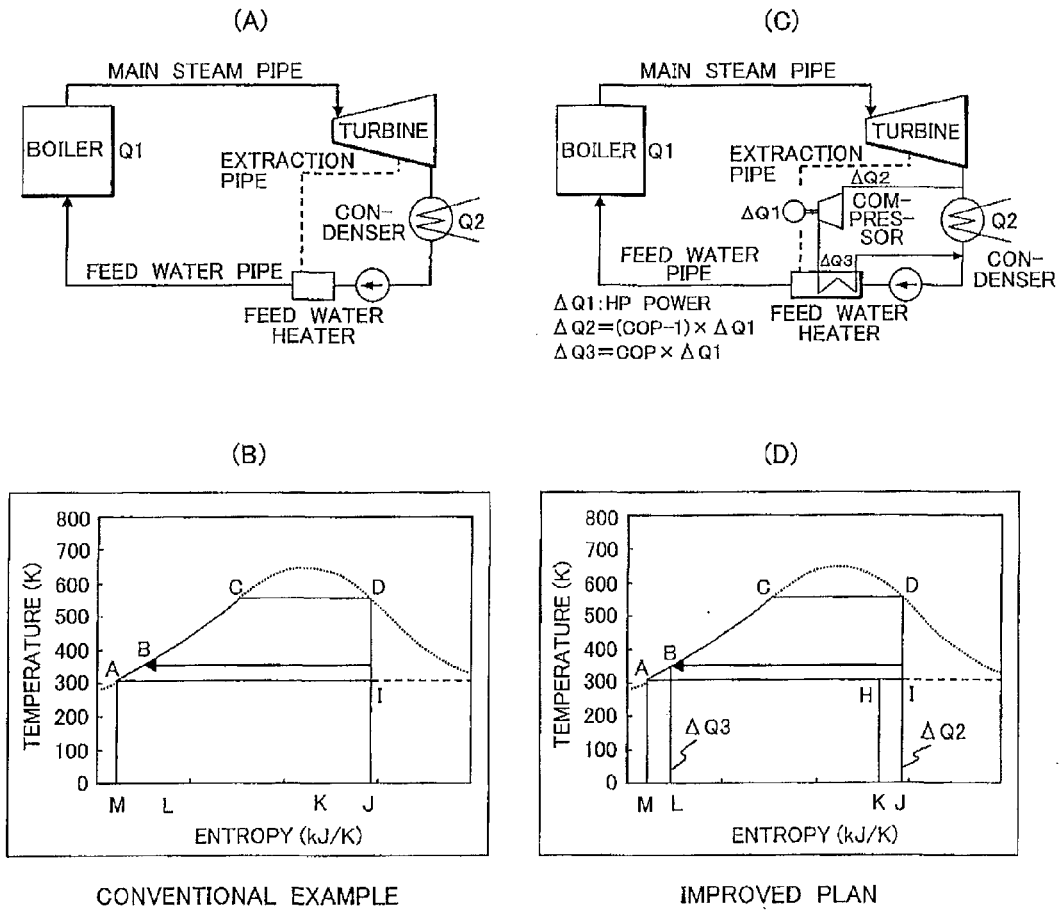
FIGS. 3(A) to 3(D) are explanatory drawings illustrating the thermodynamic cycle of the power plant.

FIG. 3(A) shows a schematic configuration diagram of the conventional power plant where a compressor is not applied. Steam generated in a boiler (steam generating apparatus) is supplied to a turbine through a main steam pipe. Steam discharged from the turbine is condensed with a condenser and becomes water. This water is supplied as feed water to the boiler through a feed water pipe. The feed water is heated by the steam extracted from the turbine and supplied to the feed water pipe.

FIG. 3(B) shows the T-S diagram of the conventional power plant shown in FIG. 3(A). Herein, "T" represents temperature and "S" represents entropy. Entropy S is obtained by multiplying commonly-used specific entropy by flow rate G. Let the amount of heat inputted from the boiler be Q1, and let the amount of heat discharged from the condenser be Q2. The amount of heat input Q1 is expressed by the area surrounded by ABCDIJKLMA, and the amount of heat discharge Q2 is expressed by the area surrounded by AIJKLMA. The task executed by the turbine is expressed as "L=Q1−Q2", which corresponds to the area surrounded by ABCDIA. Thermal efficiency η in the power plant can be calculated by "η=L/Q1".

FIG. 3(C) shows a schematic configuration diagram of the power plant according to the improved plan where a compressor is applied. The power plant according to the improved plan is configured such that a compressor is added to the configuration of the conventional power plant. In the power plant according to the improved plan, steam discharged from a turbine is compressed by a compressor, and the compressed steam is supplied to a feed water heater to which extracted steam has been supplied. Feed water supplied to a boiler is heated by both the extracted steam and the compressed steam.

FIG. 3(D) shows the T-S diagram of the power plant according to the improved plan shown in FIG. 3(C). In the improved plan as well, let the amount of heat inputted from the boiler to the turbine be $Q1_i$, and let the amount of heat discharged from the condenser be $Q2_i$. In the improved plan, because ΔQ3 energy is provided by the feed water heater, if the amount of generated steam is the same in both the conventional power plant of FIG. 3(A) and the power plant according to the improved plan of FIG. 3(C), becoming "$Q1_i$=Q1−ΔQ3" and "$Q2_i$=Q2−ΔQ2". Herein, when ΔQ1 is assumed to be shaft power of a steam heat pump equipped with a compressor, relational expressions of equation (1) and equation (2) can be established via the coefficient of performance, COP, between the motive power of the steam heat pump and the energy supplied from the steam heat pump to heat the feed water.

$$\Delta Q3=\mathrm{COP}\times\Delta Q1 \qquad \text{Eq. (1)}$$

$$\Delta Q2=(\mathrm{COP}-1)\times\Delta Q1 \qquad \text{Eq. (2)}$$

Therefore, the task executed by the turbine according to the improved plan is "$L_i=Q1_i-Q2_i$", and thermal efficiency $\eta_i$ in the power plant according to the improved plan can be calculated using the equation of "$\eta_i=L_i/Q1_i$".

The net task $L_i$ in the power plant according to the improved plan can be expressed by equation (3) wherein motive power ΔQ1 necessary for the compressor is subtracted from the task L executed by the turbine in the conventional power plant of FIG. 3(A).

$$L_i=L-\Delta Q1 \qquad \text{Eq. (3)}$$

Since "$Q1_i$=Q1−COP×ΔQ1", by rearranging both, thermal efficiency in the power plant according to the improved plan can be expressed by equation (4).

$$\eta_i=(L-\Delta Q1)/(Q1-\mathrm{COP}\times\Delta Q1) \qquad \text{Eq. (4)}$$

Because "L=η×Q1", equation (4) can be rearranged to become equation (5).

$$\eta_i/\eta\approx 1+(\Delta Q1/Q1)\times(\mathrm{COP}-1/\eta) \qquad \text{Eq. (5)}$$

In equation (5), if the right hand second term is positive, the value of the left hand is greater than 1. Accordingly, thermal efficiency in the power plant according to the improved plan is higher than the thermal efficiency in the conventional power plant shown in FIG. 3(A). Herein, the COP (coefficient of performance) is an index used for the steam heat pump to indicate the increase in net power output and efficiency and is defined by equation (6).

$$\mathrm{COP}=(Q_L+Q_h)/Q_L \qquad \text{Eq. (6)}$$

Herein, $Q_L$ represents compression motive power of the steam heat pump and $Q_h$ represents thermal energy pumped by the steam heat pump. Based on equations (1) and (2), for example, when thermal efficiency η is 0.33, if a large steam heat pump is used within a range of "COP>3", it is indicated that thermal efficiency is increased more than the thermal efficiency in the conventional example.

Figure 4:
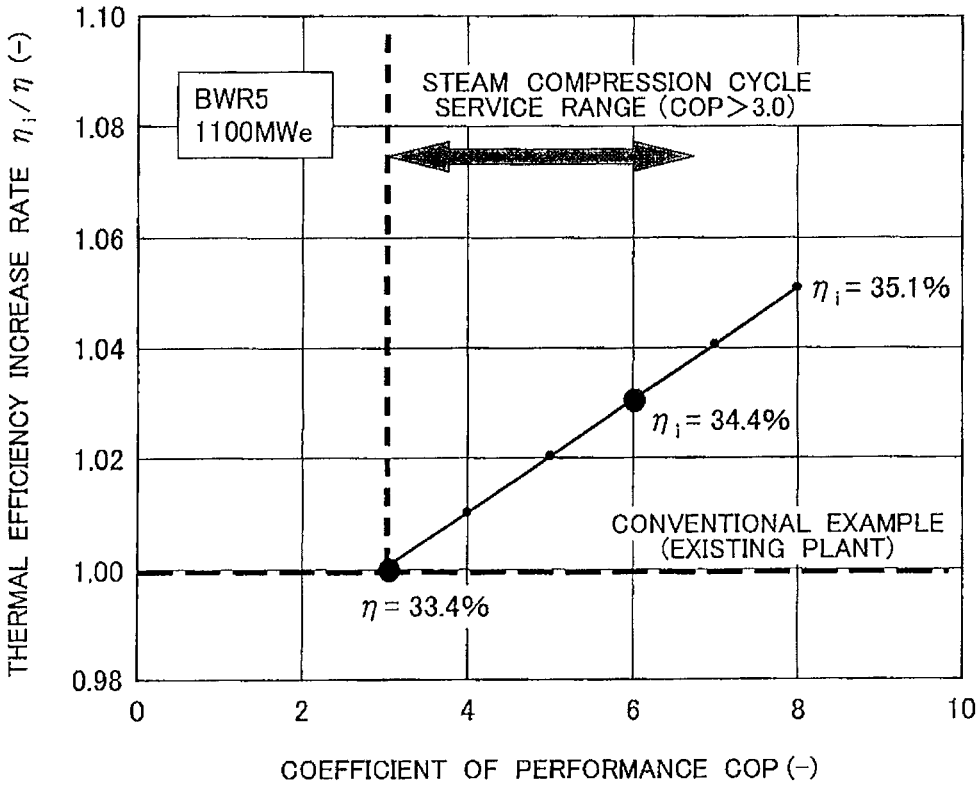
FIG. 4 is a characteristic diagram showing a relationship between the coefficient of performance of the steam compression cycle and the thermal efficiency increase rate in the power plant.

The relationship between the coefficient of performance of the steam compression cycle and the thermal efficiency increase rate in the power plant equipped with a steam compressor will be described with reference to FIG. 4. In FIG. 4, the coefficient of performance COP is plotted on the horizontal axis and thermal efficiency increase rate $\eta_i/\eta$ is plotted on the vertical axis. As an example of the power plant, a BWR5 (generating an electric power of 1100 MWe) type BWR nuclear power plant is used to explain the above-mentioned relationship. In the BWR nuclear power plant, thermal power Q1 of the nuclear reactor which works as a steam generating apparatus is 3300 MWt, and shaft power ΔQ1 of the steam compression heat pump is 33.5 MWt. Herein, when steam is compressed with a compressor until steam temperature T increases from 100° C. to 160° C., the coefficient of performance COP becomes nearly 6 and $\eta_i/\eta$ becomes 1.0305. This means that thermal efficiency η has been increased by approximately 3% in relative value and approximately 1% in absolute value and becomes 34.4% because the nominal value of thermal efficiency η in the above-mentioned conventional BWR5-type BWR nuclear power plant is 33.4% during the rated 100%-power operation (see "Nuclear power generation handbook '95, Chapter 7: Nuclear Reactor Equipment, p. 335 published by Denryoku Shinposha").

Figure 5:
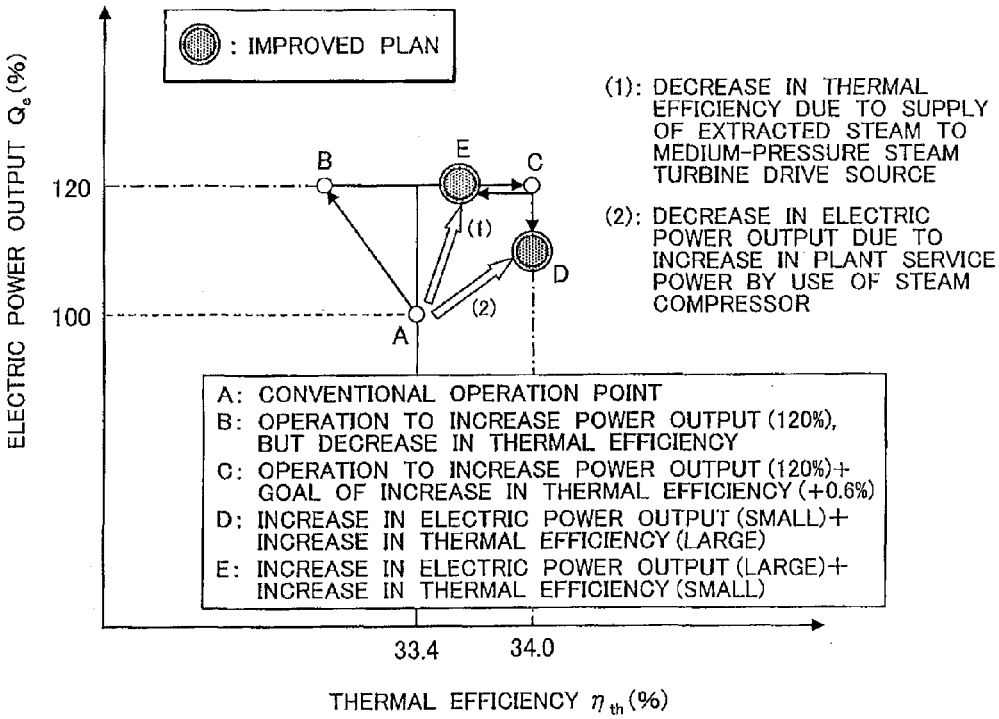
FIG. 5 is an explanatory diagram showing a relationship between the thermal efficiency and the increase in power output in the power plant.

The relationship between thermal efficiency and the increase in power output in the power plant will be described with reference to FIG. 5. As stated above, in the 1100 MWe-class BWR nuclear power plant, the nominal value of thermal efficiency during the rated 100%-power operation is approximately 33.4%. When operation is conducted to increase power output from the conventional rated 100%-power operation point A to 120%, the operation point becomes point B because thermal efficiency in the power plant decreases from the operation point A. On the other hand, in the aforementioned improved plan, in addition to the operation with 120% power, operation point C is set as a goal to be attained at which thermal efficiency in the plant is increased by 0.6% when compared with the thermal efficiency in the conventional BWR nuclear power plant. However, in this case, the following two problems arise:

(1) Thermal efficiency slightly decreases (operation point E) as the result of supplying extracted steam to the medium-pressure steam turbine drive source; and (2) Power output slightly decreases (operation point D) due to the increase in consumption of plant service power because the steam compressor is used and driven.

A provisional estimate indicates that the consumption rate of the plant service power as the result of driving the steam compressor is approximately 2 to 5%. Due to the above problems (1) and (2), it is difficult to achieve the target operation point C, however, at the operation points D and E, power output and plant thermal efficiency can be increased when compared with the conventional operation point A (100% power and plant thermal efficiency of 33.4%).

Figure 6:
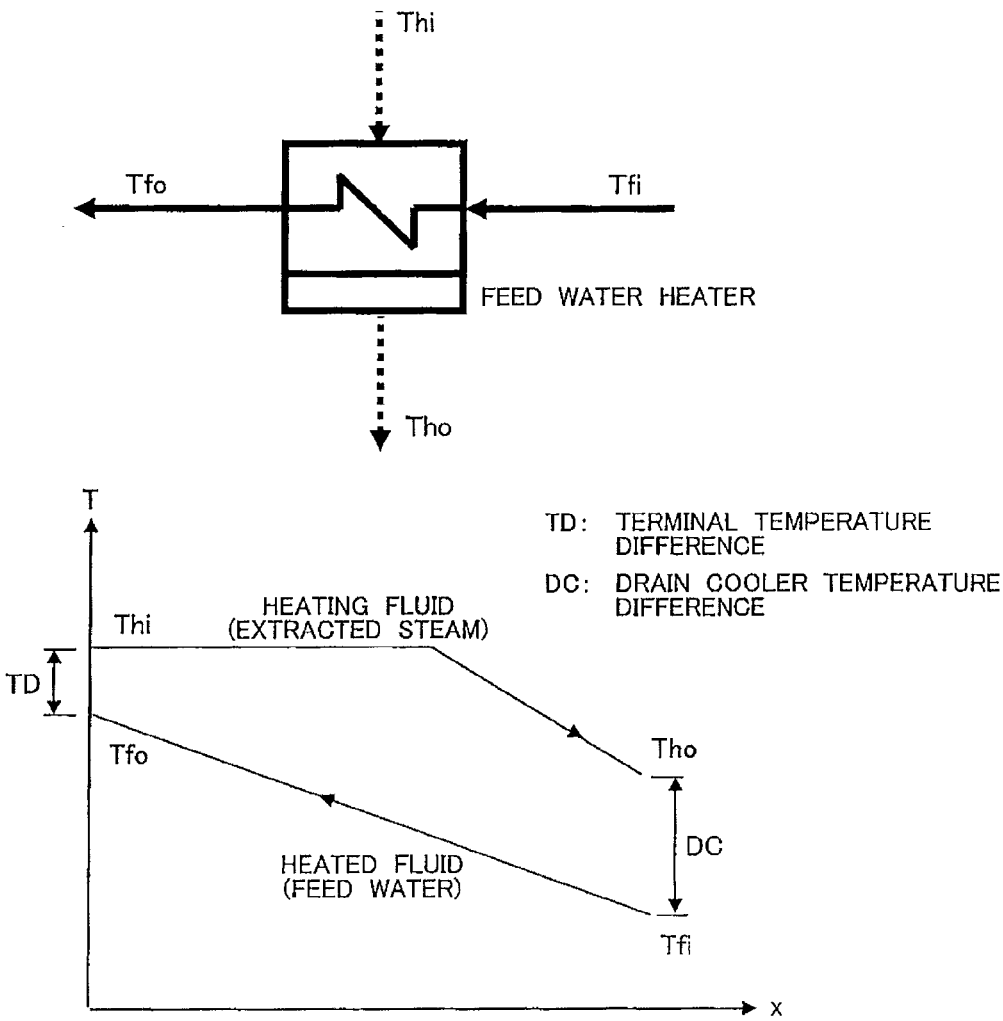
FIG. 6 is an explanatory diagram showing the temperature distribution in the feed water heater.

FIG. 6 shows an explanatory diagram indicating the temperature distribution in the feed water heater provided for the feed water pipe. A nuclear power plant is generally equipped with altogether six feed water heaters: two high-pressure feed water heaters and four low-pressure feed water heaters. Each feed water heater is a heat exchanger configured such that a plurality of U-shaped heat transfer pipes is disposed in the horizontal barrel. Low-temperature feed water flows through the heat transfer pipes, and steam extracted from a high-pressure turbine or a low-pressure turbine is supplied from a nozzle provided for the barrel of the feed water heater to the outside of the heat transfer pipes within the barrel. Feed water flowing through the heat transfer pipes is heated by the extracted steam supplied to the inside of the barrel.

Although thermal exchange is conducted between the feed water which is heated fluid and the extracted steam, temperature increases due to sensible heat while the single-phase flow remain unchanged. The extracted steam that is heating fluid condenses from saturated steam due to thermal exchange with feed water, gradually supercools, and collects as drainage water in the bottom portion of the feed water heater. The drainage water flows through each feed water heaters from the high-temperature and high-pressure side to the low-temperature and low-pressure side due to pressure difference, the heat is recovered in the cascading manner with each feed water heater, and finally, the water is supplied to a hot well located in the condenser.

When designing a feed water heater, as an approximation temperature between the feed water and the extracted steam, the difference between the extracted steam inlet temperature and the feed water outlet temperature is defined as terminal temperature difference TD. Furthermore, the difference between the extracted steam outlet temperature and the feed water inlet temperature is defined as drain cooler temperature difference DC. If the area of heat transfer of the feed water heater remains unchanged from the existing one, by increasing the flow rate of the extracted steam for heating which is an operation condition specification of the feed water heater, it is possible to make the terminal temperature difference TD small. That is, feed water outlet temperature Tfo can be increased. Furthermore, increasing the bore diameter of the extraction pipe that directs extracted steam will reduce friction loss in the extraction pipe and decrease pressure loss, thereby increasing the amount of extracted steam. In addition to the flow rate of the extracted steam supplied to the feed water heater, by supplying steam compressed with a steam compressor and whose temperature has been increased to the feed water heater for heating purposes, the amount of steam for heating the feed water supplied to the feed water heater increases. Consequently, the amount of heat for heating the feed water increases, and feed water outlet temperature Tfo increases without changing the area of the heat transfer pipe per feed water heater. That is, it is possible to easily increase thermal efficiency in the power plant.

Since thermal efficiency η in the BWR5-type BWR nuclear power plant is 33.4% during rated 100%-power operation as stated above, the steam compressor of the steam heat pump may be connected to the steam extraction point of the main steam system and the feed water heater so that the COP can be larger than 3. If applied to an advanced boiling water reactor (ABWR) nuclear power plant, because thermal efficiency in this nuclear power plant is 34.5%, the steam compressor of the steam heat pump may be connected to the steam extraction point of the main steam system and the feed water heater so that the COP can be larger than 2.9. If applied to a fast breeder reactor (FBR) power plant, because thermal efficiency in this FBR power plant is 41.9%, the steam compressor of the steam heat pump may be connected to the steam extraction point of the main steam system and the feed water heater so that the COP can be larger than 2.38. If applied to a combined thermal power plant, because thermal efficiency in the combined thermal power plant is 42%, the steam compressor of the steam heat pump may be connected to the steam extraction point of the main steam system and the feed water heater so that the COP can be larger than 2.38.

Figure 7:
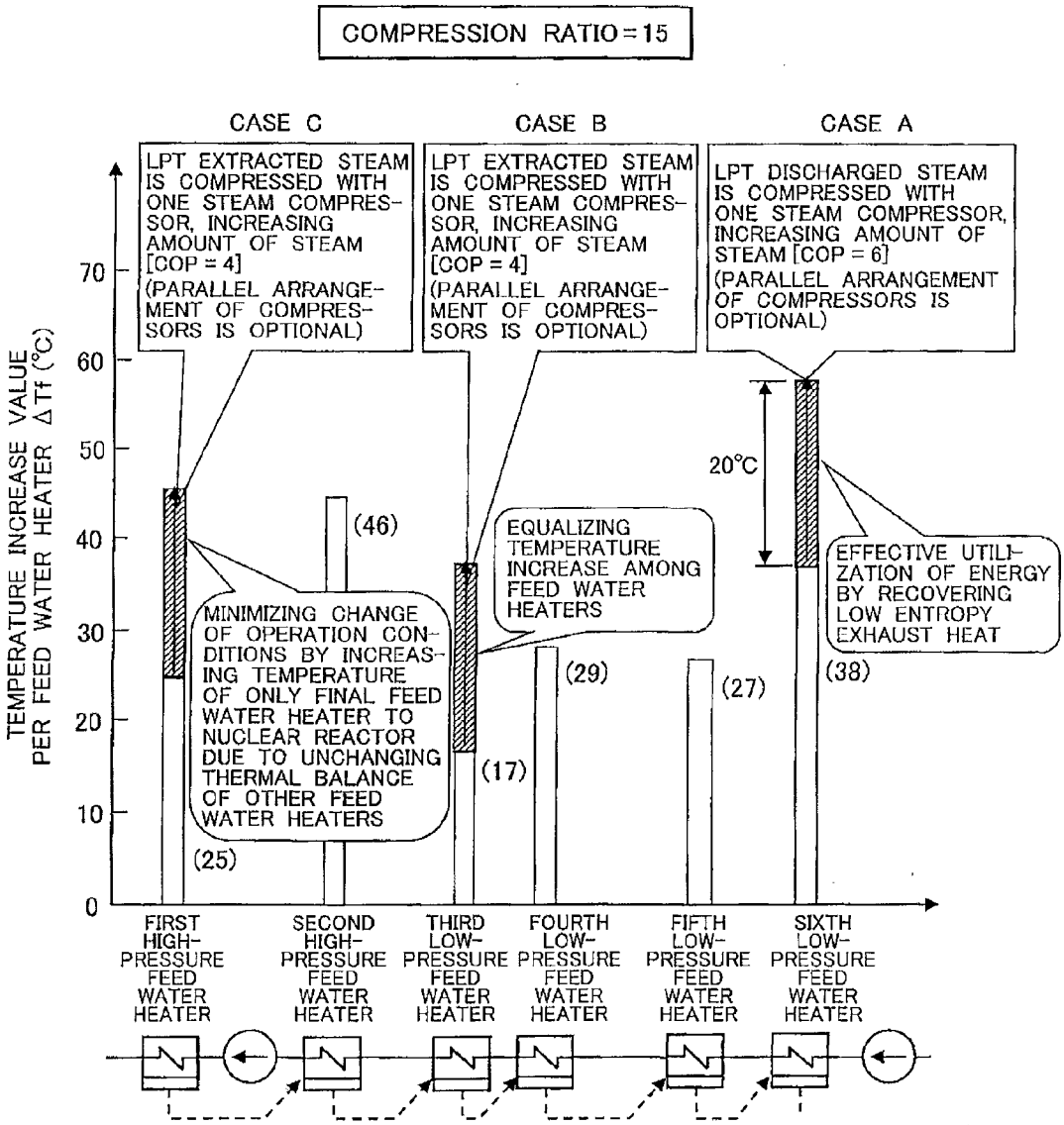
FIG. 7 is an explanatory diagram showing three specific examples of the power plant according to the improved plan shown in FIG. 3(C).

An increase in the feed water temperature in each feed water heater in the above-mentioned improved plan will be described with reference to FIG. 7. As shown in FIG. 7, a BWR nuclear power plant is equipped with six feed water heaters for the feed water pipe thereof. For the feed water pipe, are disposed sequentially from the side of the nuclear reactor which works as a steam generating apparatus a first high-pressure feed water heater, a second high-pressure feed water heater, a third low-pressure feed water heater, a fourth low-pressure feed water heater, a fifth low-pressure feed water heater, and a sixth low-pressure feed water heater. By referring to the "Nuclear power generation handbook '95, Chapter 7: Nuclear Reactor Equipment, p. 355, published by Denryoku Shinposha", the increase in temperature of each feed water in the six feed water heaters disposed in an 1100 MWe-class BWR nuclear power plant is shown in FIG. 7. The bar graph of FIG. 7 indicates the temperature increase value of the feed water in each feed water heater. The temperature increase value appears in parenthesis next to the bar graph. The temperature increase value of the feed water ranges from a minimum of 17° C. to a maximum of 46° C., and a temperature difference of approximately 29° C. is indicated among those feed water heaters.

In the aforementioned improved plan, the inventors assumed three specific examples in which steam compressed with a compressor is supplied to three specifically located feed water heaters (first high-pressure feed water heater, third low-pressure feed water heater, and sixth low-pressure feed water heater). For descriptive purposes, let the situation in which steam is supplied to the sixth low-pressure feed water heater be Case A, let the situation in which steam is supplied to the third low-pressure feed water heater be Case B, and let the situation in which steam is supplied to the first high-pressure feed water heater be Case C. In those cases, the compression ratio in the steam compressor is conservatively set at 15. Each case will be described below. Moreover, in Cases A, B and C, other than the steam compressed with a compressor, steam extracted from the main steam system, such as a low-pressure turbine or the like, is supplied to the relevant feed water heater without the steam passing through the steam compressor.

(a) In Case A, steam having a pressure of 5 kPa discharged from a low-pressure turbine (LPT) is compressed with one steam compressor, and the pressure of the compressed steam is regulated so that it decreases to 40.4 kPa with a control valve. Then, the compressed steam is supplied to the sixth low-pressure feed water heater. In this process, if another steam compressor is disposed in parallel to the former steam compressor, the flow rate of the steam supplied to the feed water heater can be further increased. Because, in Case A, exhaust heat is recovered from the steam discharged from the lowest-entropy and low-pressure turbine, Case A is the most efficient method for the feed water heating system in a BWR nuclear power plant. Obviously, it is necessary to change conditions of the extracted steam from the fifth low-pressure feed water heater to the first high-pressure feed water heater since temperature of feed water in the sixth low-pressure feed water heater has increased by 20° C. Furthermore, electric power consumed by driving the steam compressor increases.

(b) In Case B, steam having a pressure of 40 kPa discharged from a low-pressure turbine is compressed with one steam compressor, and the pressure of the compressed steam is regulated to decrease to 465 kPa with a control valve. Then, the compressed steam is supplied to the third low-pressure feed water heater. In this process, if another steam compressor is disposed in parallel to the former steam compressor, the flow rate of the steam supplied to the third low-pressure feed water heater can be further increased. Case B aims to equalize the balance of the temperature increase of the feed water heater by providing the effect of recovery of exhaust heat for the third low-pressure feed water heater having a feed water temperature increase of 17° C. which is the lowest among all the six feed water heaters. By doing so, regenerative cycle thermal efficiency can be increased as the result of the optimization of the extraction conditions. Furthermore, drainage water discharged from a moisture separator provided for the main steam pipe that connects the high-pressure turbine to the low-pressure turbine is supplied to the third low-pressure feed water heater as a heating source for heating the feed water. This drainage water is supplied to the third low-pressure feed water heater as a large liquid mass. The purpose of supplying steam compressed with a compressor to the third low-pressure feed water heater is also to increase the area of thermal exchange with the feed water by making the drainage water microparticulated. In this case, conditions of extracted steam supplied to the first high-pressure feed water heater and the second high-pressure feed water heater need to be changed.

(c) In Case C, steam having a pressure of 278 kPa discharged from a low-pressure turbine is compressed with one steam compressor, and the pressure of the compressed steam is regulated to decrease to 2.36 MPa with a control valve. Then, the compressed steam is supplied to the first high-pressure feed water heater. In this process, if another steam compressor is disposed in parallel to the former steam compressor, the flow rate of the steam supplied to the first high-pressure feed water heater can be further increased. Because, in Case C, the temperature of feed water supplied to the first high-pressure feed water heater located on the final stage closest to the nuclear reactor which works as a steam generating apparatus is increased by the compressed steam, it is not necessary to change conventional conditions, such as conditions of extracted steam supplied to five other feed water heaters. Therefore, the feed water temperature can be increased by the slightest alteration of the BWR nuclear power plant and the slightest change of the operation conditions, thereby making it relatively easy to configure a feed water heating system utilizing the exhaust heat recovery.

With regard to the typical three cases, i.e., Cases A, B and C, an explanation has been given about the method that simultaneously uses the steam compressed with a compressor in addition to the steam extracted from the main steam system without passing through a compressor to increase the amount of heat for heating the feed water. Within the range of the compression ratio of the steam compressor from 15 to 20, low-temperature and low-pressure steam (relatively low-quality steam) is compressed with a steam compressor and then supplied to the feed water heaters other than the feed water heater which is the target in those three cases and to which compressed steam is supplied, thereby enabling the recovery of the exhaust heat. If extracted steam and exhaust steam from the low-pressure turbine are compressed and used, the compressed steam can be supplied to the first high-pressure feed water heater having a maximum pressure, and recovery of exhaust heat is sufficiently possible. Furthermore, if supply balance of the compressed steam to the feed water heaters is optimized, a dispersion supply method can be positively considered in which the temperature of each feed water heater increases by several degrees.

Figure 8:
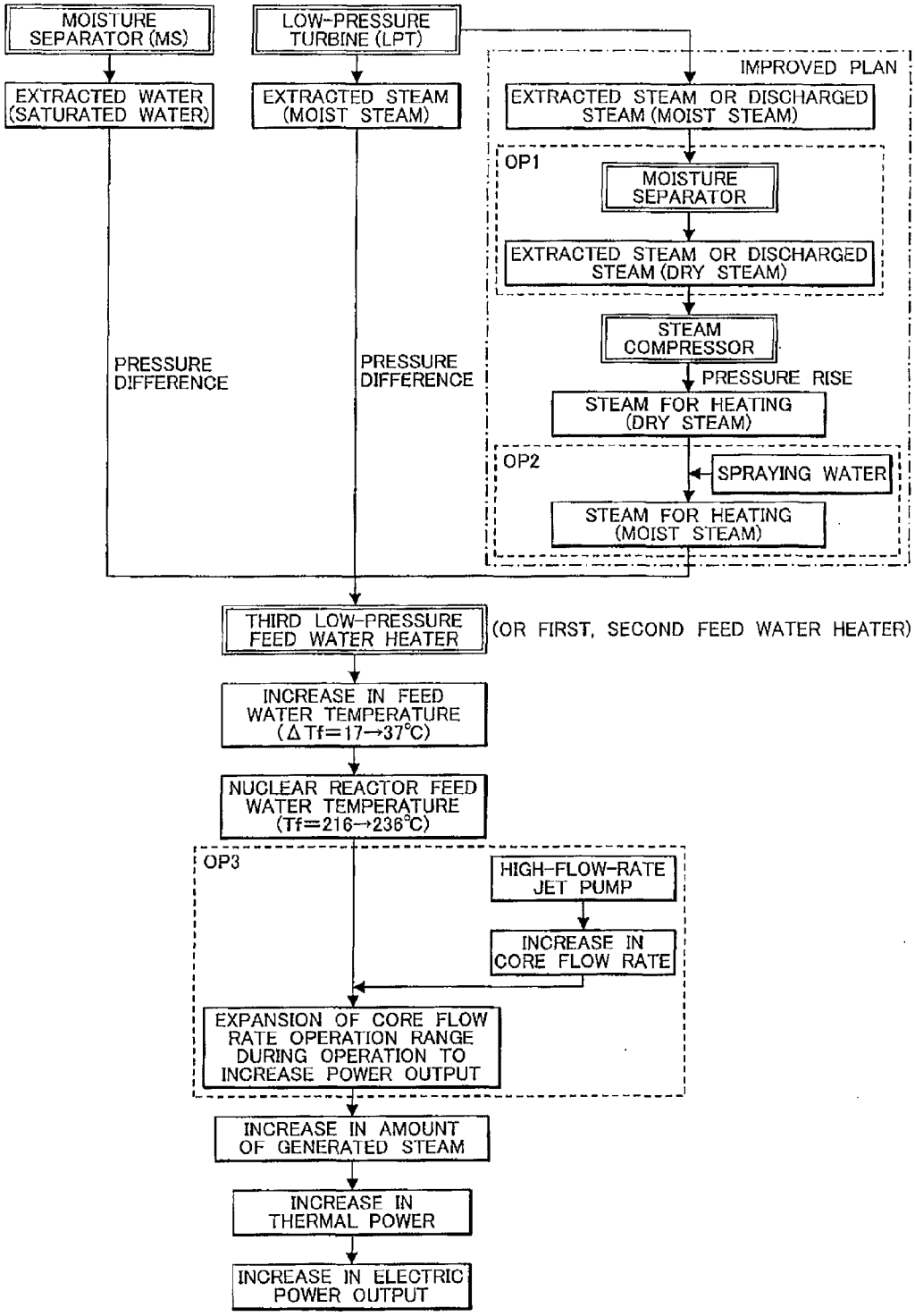
FIG. 8 is an explanatory diagram showing an outline of the improved plan for a BWR nuclear power plant.

Outline of the BWR nuclear power plant according to the improved plan that has been obtained as the result of the aforementioned studies will be described with reference to FIG. 8. The following description of the improved plan takes, as a typical example, a power plant where steam compressed with a compressor is supplied to the third low-pressure feed water heater. Meanwhile, the description will be the same when other feed water heaters, such as the first and the second high-pressure feed water heaters, are taken.

In order to heat feed water, the extracted steam which is moist steam extracted from the low-pressure turbine is supplied to the third low-pressure feed water heater in the BWR nuclear power plant via an extraction pipe. Also, the saturated drainage water discharged from the moisture separator and whose moisture has been eliminated is supplied. Supply of the extracted steam to the third low-pressure feed water heater is executed by the pressure difference between the steam extraction point of the low-pressure turbine and the third low-pressure feed water heater. Supply of the saturated drainage water to the third low-pressure feed water heater is executed by the pressure difference between the moisture separator and the third low-pressure feed water heater. In this improved plan, in addition to the supply of the extracted steam and the saturated drainage water, extracted steam or exhaust steam from the low-pressure turbine is compressed with the steam compressor and supplied to the third low-pressure feed water heater as compressed steam for heating.

There is an option OP1 in which a plan to dispose a moisture separator upstream of the steam compressor is simultaneously applied. The installation of the moisture separator will enable the steam supplied to the steam compressor to become dry steam by removing moisture.

There is another option OP2 in which a plan to spray water mist to the dry steam compressed by the steam compressor is simultaneously applied. The purpose of spraying water mist is to prevent performance of the steam compressor from decreasing when dry steam has rapidly compressed on the discharge side of the steam compressor and the temperature of compressed steam has become too high. Sometimes compressed steam for heating supplied from the steam compressor to the third low-pressure feed water heater can become moist steam by spraying water mist. Spraying water mist provides more steam for heating to the third low-pressure feed water heater than the conventional methods, which increases feed water temperature in the third low-pressure feed water heater. Therefore, it is possible to increase feed water temperature by approximately 20° C. in the third low-pressure feed water heater when compared to the conventional method, thereby making it possible to supply higher-temperature feed water to the nuclear reactor. By doing so, the flow rate of the steam discharged from the nuclear reactor is increased, which can increase electric power output in proportion to the increase in thermal power output.

There is still another option OP3 in which a plane is to combine high-flow-rate jet pumps. By simultaneously using option OP3, during running nuclear power generation, in particular when power output is increased to 120%, it is possible to expand the operation range in the core flow rate control. Therefore, it is possible to operate the nuclear reactor without using control rods by replacing the operation method for conventional BWR nuclear power plant where nuclear reactor output is controlled by the core flow rate and the control rod operation with an operation method for BWR nuclear power plant where the core flow rate control and the feed water temperature control are simultaneously used with option OP3 in which coolant is supplied to the core with high-flow-rate jet pumps. For this reason, by increasing the core flow rate from the initial phase to the last phase of the operation cycle and by decreasing the core inlet cooling water temperature, even during operation to increase plant power output, it is possible to ensure the core flow rate range equivalent to that during rated power operation; thus, the electric power output can be increased by 20%. Moreover, because the use of option OP3 does not require the installation of control rods, the duration for once periodic inspection can be shortened.

Embodiments of the present invention created based on the aforementioned improved plan will be hereinafter described in detail.

First Embodiment

An electric power plant according to a first embodiment which is a preferred embodiment of the present invention will be described with reference to FIG. 1. The electric power plant in this embodiment is an 1100 MWe BWR-5 type BWR nuclear power plant.

The BWR nuclear power plant 1 includes: a nuclear reactor 2 working as a steam generating apparatus; a high-pressure turbine (first turbine) 3; low-pressure turbines (second turbines) 5A, 5B and 5C; a main steam pipe 6; a condenser 11; a plurality of feed water heaters; a feed water pipe 15; and a steam compression apparatus 27. Those feed water heaters include: a first high-pressure feed water heater 16A; a second high-pressure feed water heater 16B; a third low-pressure feed water heater (first low-pressure feed water heater) 17A; a fourth low-pressure feed water heater (second low-pressure feed water heater) 17B; a fifth low-pressure feed water heater (third low-pressure feed water heater) 17C; and a sixth low-pressure feed water heater (fourth low-pressure feed water heater) 17D. The low-pressure feed water heater is a feed water heater to which steam extracted from the low-pressure turbine is supplied. The high-pressure feed water heater is a feed water heater to which steam extracted from the high-pressure turbine or the main steam pipe 6 located on the high-pressure turbine's outlet side is supplied. The high-pressure turbine 3 and the low-pressure turbines 5A, 5B, and 5C are connected to the nuclear reactor 1 via the main steam pipe 6. A moisture separator (moisture separation apparatus) 4 is installed in the main steam pipe 6 that connects the high-pressure turbine 3 and the low-pressure turbines 5A, 5B and 5C. An isolation valve 7 and a main steam-regulating valve 8 are installed in the main steam pipe 6 located between the nuclear reactor 1 and the high-pressure turbine 3. The high-pressure turbine 3 and the low-pressure turbines 5A, 5B, and 5C are connected to one another via one rotational axis 10 and are also connected to a generator 9. In this embodiment, one high-pressure turbine and three low-pressure turbines are provided, however, the number of those turbines can be changed according to the type of electric power plant.

This embodiment has a main steam system and a feed water system. The main steam system comprises: the high-pressure turbine 3; the moisture separator 4; the low-pressure turbines 5A, 5B, and 5C; the main steam pipe 6; and the condenser 11. The feed water system comprises: the feed water pipe 15; the first high-pressure feed water heater 16A; the second high-pressure feed water heater 16B; the third low-pressure feed water heater 17A; the fourth low-pressure feed water heater 17B; the fifth low-pressure feed water heater 17C; the sixth low-pressure feed water heater 17D; a condenser pump 18; and a feed water pump 19.

The condenser 11 is provided with a plurality of heat transfer pipes 12 inside thereof. Those heat transfer pipes 12 are connected to a seawater feed pipe 13A and a seawater drain pipe 13B. A seawater circulation pump 14 is installed in the seawater feed pipe 13A. The seawater feed pipe 13A and the seawater drain pipe 13B extend to the sea 35.

The feed water pipe 15 connects the condenser 11 to the nuclear reactor 2. To the feed water pipe 15 in sequential order from the nuclear reactor 2 side to the condenser 11 side are connected the first high-pressure feed water heater 16A, second high-pressure feed water heater 16B, third low-pressure feed water heater 17A, fourth low-pressure feed water heater 17B, fifth low-pressure feed water heater 17C, and the sixth low-pressure feed water heater 17D. The condenser pump 18 is provided for the feed water pipe 15 between the condenser 11 and the sixth low-pressure feed water heater 17D. The feed water pump 19 is provided for the feed water pipe 15 between the first high-pressure feed water heater 16A and the second high-pressure feed water heater 16B.

An extraction pipe 20 connected to the high-pressure turbine 3 at a steam extraction point (first location) of the high-pressure turbine 3 is connected to the first high-pressure feed water heater 16A. An extraction pipe 21 connected to the main steam pipe 6 located between the high-pressure turbine 3 and the moisture separator 4 is connected to the second high-pressure feed water heater 16B. An extraction pipe 22 connected to the low-pressure turbine 5B at a steam extraction point 71 is connected to the third low-pressure feed water heater 17A. A drainage pipe 26 connected to the moisture separator 4 is connected to the third low-pressure feed water heater 17A. An extraction pipe 23 connected to the low-pressure turbine 5B at a steam extraction point 72 is connected to the fourth low-pressure feed water heater 17B. An extraction pipe 24 connected to the low-pressure turbine 5B at a steam extraction point 73 is connected to the fifth low-pressure feed water heater 17C. An extraction pipe 25 connected to the low-pressure turbine 5B at a steam extraction point 74 is connected to the sixth low-pressure feed water heater 17D. The steam extraction points 71, 72, 73, and 74 are sequentially provided in the axial direction of the low-pressure turbine 5B from a steam inlet of the low-pressure turbine 5B to a steam outlet of the low-pressure turbine 5B. Those steam extraction points are provided in the turbine casing (not shown) of the low-pressure turbine 5B on different stages of a plurality of stator blades provided in the low-pressure turbine 5B. A drainage water recovery pipe 34 that connects the first high-pressure feed water heater 16A, second high-pressure feed water heater 16B, third low-pressure feed water heater 17A, fourth low-pressure feed water heater 17B, fifth low-pressure feed water heater 17C, and the sixth low-pressure feed water heater 17D is connected to the condenser 11.

In FIG. 1, although the low-pressure turbine 5B is drawn larger than the low-pressure turbines 5A and 5C, the size of those low-pressure turbines is actually the same. Each of the low-pressure turbines 5A and 5C is provided with a condenser 11, not shown, and the feed water pipe 15 is connected to each condenser 11. The feed water pipes 15 separately connected to three condensers 11 provided to correspond to each low-pressure turbine 5A, 5B, and 5C are joined at a junction point located upstream of the second high-pressure feed water heater 16B and then connected to the second high-pressure feed water heater 16B. Upstream of the junction point, three feed water pipes 15 disposed in parallel for respective low-pressure turbines 5A, 5B, and 5C are provided with low-pressure feed water heaters of: the third low-pressure feed water heater 17A; fourth low-pressure feed water heater 17B; fifth low-pressure feed water heater 17C; and the sixth low-pressure feed water heater 17D, and the condenser pump 18 sequentially located from downstream to upstream. Therefore, for each of the low-pressure turbines 5A and 5C, a feed water pipe 5 provided with the third low-pressure feed water heater 17A, fourth low-pressure feed water heater 17B, fifth low-pressure feed water heater 17C, and the sixth low-pressure feed water heater 17D, and the condensate pump 18 is disposed upstream of the second high-pressure feed water heater 16B. Each of the low-pressure turbines 5A and 5C is provided with the steam extraction points 71, 72, 73, and 74 in the same manner as the low-pressure turbine 5B. Extraction pipes 22, 23, 24, and 25 are respectively connected to the steam extraction points 71, 72, 73, and 74 of the low-pressure turbine 5A in the same manner as the low-pressure turbine 5B. The extraction pipes 22, 23, 24, and 25 connected to the low-pressure turbine 5A are respectively connected to the third low-pressure feed water heater 17A, fourth low-pressure feed water heater 17B, fifth low-pressure feed water heater 17C, and the sixth low-pressure feed water heater 17D provided for the low-pressure turbine 5A in the same manner as the low-pressure turbine 5B. Extraction pipes 22, 23, 24, and 25 are also connected to the steam extraction points 71, 72, 73, and 74 of the low-pressure turbine 5C in the same manner as the low-pressure turbine 5B. Extraction pipes 22, 23, 24, and 25 connected to the low-pressure turbine 5C are respectively connected to the third low-pressure feed water heater 17A, fourth low-pressure feed water heater 17B, fifth low-pressure feed water heater 17C, and the sixth low-pressure feed water heater 17D provided for the low-pressure turbine 5C in the same manner as the low-pressure turbine 5B.

In the descriptions below, the third low-pressure feed water heater 17A, fourth low-pressure feed water heater 17B, fifth low-pressure feed water heater 17C, sixth low-pressure feed water heater 17D, extraction pipes 22, 23, 24 and 25, and the steam extraction points 71, 72, 73 and 74 are for those provided for the low-pressure turbine 5B unless otherwise specified.

The steam compression apparatus 27 includes a steam compressor 28, a drive apparatus (for example, a motor) 29, and a control valve 30. The drive apparatus 29 is connected to the rotational axis of the steam compressor 28. The steam feed pipe 31 connected to the steam extraction point 71 (second location) of the low-pressure turbine 5B is connected to a steam inlet of the steam compressor 28. The steam feed pipe 32 connects a steam outlet of the steam compressor 28 to the first high-pressure feed water heater 16A. The steam feed pipes 31 and 32 are the second pipes, and in this embodiment, the extraction pipe 20 is the first pipe. The control valve 30 is provided in the steam feed pipe 32. A steam compressor 28 is not provided for the extraction pipes 20 to 25 through which the extracted steam flows. A single-stage centrifugal water-steam compressor is used as a steam compressor 28. Another type of compressor may be used as a steam compressor 28. The steam compressor 28 and the drive apparatus 29 are installed in the vacant space in the turbine building.

The steam extraction point 71 to which the extraction pipe 22 is connected and the steam extraction point 71 to which the steam feed pipe 31 is connected are separated from each other in the circumferential direction of the low-pressure turbine 5B at locations on the same stage of the stator blades provided in the low-pressure turbine 5B. The steam compression apparatus 27 provided for each of the low-pressure turbines 5A and 5C is also connected to the first high-pressure feed water heater 16A in the same manner. The steam feed pipe 31 may be connected to the extraction pipe 22. The cross-sectional area of the flow channel of the steam feed pipe 31 is made smaller than that of the extraction pipe 22 so that the amount of steam supplied to the third low-pressure feed water heater 17A through the extraction pipe 22 will not be reduced by driving the steam compressor 28. Instead of changing the cross-sectional area of the pipe's flow channel, it is possible to provide a flow-rate regulating valve in the steam feed pipe 31 thereby regulating the amount of steam supplied to the steam compressor 28. The method of regulating the steam flow rate by changing the cross-sectional area of the flow channel of the extraction pipe and the steam feed pipe 31, or the method of regulating the steam flow rate by a flow-rate regulating valve provided in the steam feed pipe 31 is applied to each embodiment from a second embodiment to a twelfth embodiment, to be described later.

Cooling water is supplied to the core (not shown) in the nuclear reactor 2 with the recirculation pump (not shown) and the jet pump (not shown). The cooling water is heated by heat generated by nuclear fission of a nuclear fuel substance contained in a plurality of fuel assemblies (not shown) loaded in the core, and a portion of that cooling water becomes steam. The steam generated in the nuclear reactor 2 is supplied to the high-pressure turbine 3 and the low-pressure turbines 5A, 5B, and 5C through the main steam pipe 6. Moisture of the steam discharged from the high-pressure turbine 3 is removed with the moisture separator 4 and then directed to the low-pressure turbines 5A, 5B, and 5C. Air pressure in the low-pressure turbines 5A, 5B, and 5C is lower than that in the high-pressure turbine 3. The high-pressure turbine 3 and the low-pressure turbines 5A, 5B, and 5C are driven by the steam, rotating the generator 9. This mechanism generates electric power. The steam discharged from the low-pressure turbines 5A, 5B, and 5C is condensed with the condenser 11 and becomes water. Seawater is supplied to each heat transfer pipe 12 located in the condenser 11 through the seawater feed pipe 13A with the seawater circulation pump 14. The seawater discharged from each heat transfer pipe 12 is discharged into the sea 35 through the seawater discharge pipe 13B. The steam discharged from the low-pressure turbines 5A, 5B, and 5C is cooled and condensed by seawater that flows through the heat transfer pipe 12 located in each condenser 11 provided correspondingly. As the result of the steam condensation, temperature of seawater flowing through each heat transfer pipe 12 increases.

Each condenser pump 18 and each feed water pump 19 are driven. The condensed water generated with each condenser 11 is pumped as feed water with each pump increasing the pressure and then supplied to the nuclear reactor 2 through the feed water pipe 15. The feed water flowing through the feed water pipe 15 is sequentially heated by the sixth low-pressure feed water heater 17D, fifth low-pressure feed water heater 17C, fourth low-pressure feed water heater 17B, and the third low-pressure feed water heater 17A provided for each of the low-pressure turbines. Subsequently, the feed water is further heated by the second high-pressure feed water heater 16B and the first high-pressure feed water heater 16A commonly used for the low-pressure turbines 5A, 5B and 5C, increasing the temperature, and when the specified temperature is reached, the feed water is supplied to the nuclear reactor 2.

In the sixth low-pressure feed water heater 17D, the feed water is heated by the steam extracted from the steam extraction point 74 of the low-pressure turbine 5B and supplied through the extraction pipe 25. In the fifth low-pressure feed water heater 17C, the feed water is heated by the steam extracted from the steam extraction point 73 of the low-pressure turbine 5B and supplied through the extraction pipe 24. In the fourth low-pressure feed water heater 17B, the feed water is heated by the steam extracted from the steam extraction point 72 of the low-pressure turbine 5B and supplied through the extraction pipe 23. In the third low-pressure feed water heater 17A, the feed water is heated by both the steam extracted from the steam extraction point 71 of the low-pressure turbine 5B and supplied through the extraction pipe 22 and the saturated drainage water discharged from the moisture separator 4 and supplied through the drainage pipe 26. In the second high-pressure feed water heater 16B, the feed water is heated by the steam extracted from the main steam pipe 6 and supplied through the extraction pipe 21. In the first high-pressure feed water heater 16A, the feed water is heated by the steam extracted from the steam extraction point (first location) of the high-pressure turbine 3 and supplied through the extraction pipe 20.

In the sixth low-pressure feed water heater 17D, fifth low-pressure feed water heater 17C, fourth low-pressure feed water heater 17B, and the third low-pressure feed water heater 17A provided for each of the low-pressure turbines 5A and 5C, each of the above-mentioned extracted steam is used to heat the feed water flowing through each feed water pipe 15.

Next, functions of the steam compression apparatus 27 will be described. Plant service power, i.e., electric power generated by the generator 9, drives the drive apparatus 29, rotating the rotor provided with the rotor blades of the steam compressor 28. The steam extracted from the steam extraction point 71 of the low-pressure turbine 5B is supplied to the steam compressor 28 through the steam feed pipe 31. After the air pressure of this steam has been increased by the steam being compressed with the steam compressor 28, the steam is discharged into the steam feed pipe 32. Since adiabatic compression of the steam is executed with the steam compressor 28, temperature of the steam also increases. The temperature of the compressed steam rises close to the temperature of the steam extracted through the extraction pipe 20 from the high-pressure turbine 3. The steam whose temperature and pressure have been increased is regulated by adjusting the opening of the control valve 30 so that the steam pressure becomes greater than the pressure in the barrel of the first high-pressure feed water heater 16A and the compressed steam does not reversely flow into the extraction pipe 20 through the barrel of the first high-pressure feed water heater 16A. Then, the steam is supplied to the barrel side of the first high-pressure feed water heater 16A through the steam feed pipe 32. The extracted steam supplied through the extraction pipe 20 is also supplied to the barrel side of the first high-pressure feed water heater 16A. In the first high-pressure feed water heater 16A, the feed water is heated by both the extracted steam supplied through the extraction pipe 20 and the compressed steam supplied through the steam feed pipe 32.

The steam compression apparatus (steam heat pump) 27 is also provided for each of the low-pressure turbines 5A and 5C. The steam compression apparatus 27 provided for the low-pressure turbine 5A compresses the steam extracted from the steam extraction point 71 of the low-pressure turbine 5A and supplies the steam to the first high-pressure feed water heater 16A. The steam compression apparatus 27 provided for the low-pressure turbine 5C compresses the steam extracted from the steam extraction point 71 of the low-pressure turbine 5C and supplies the steam to the first high-pressure feed water heater 16A.

Figure 2:
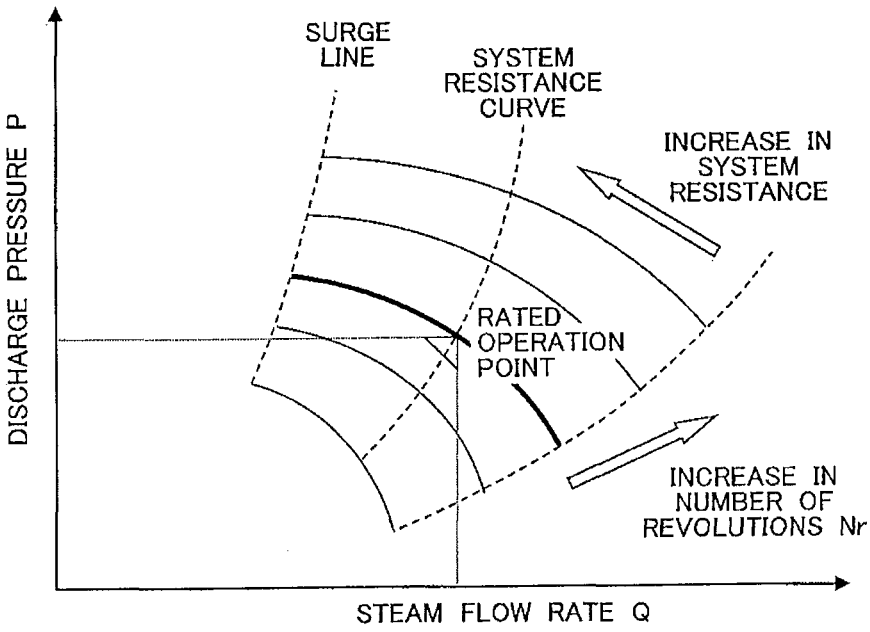
FIG. 2 is an explanatory diagram showing characteristics of the steam compressor shown in FIG. 1.

FIG. 2 is an explanatory diagram showing characteristics of the steam compressor 28. In FIG. 2, flow rate Q of the steam supplied to the steam compressor is plotted on the horizontal axis, discharge pressure P of the steam discharged from the steam compressor is plotted on the vertical axis, and the number of revolutions Nr is used as a parameter. The rated operation point of the steam compressor 28 is determined based on the Q-P characteristic line and the system resistance curve on the steam compressor's intake side and discharge side. As the number of revolutions of the steam compressor 28 increases, flow rate Q of the steam discharged from the steam compressor 28 and steam discharge pressure P also increase. A variable-frequency supply apparatus may be used to control the number of revolutions and power output of the drive apparatus 29 for the steam compressor 28. It is also possible to use a variable-frequency supply apparatus to change the rated operation point of the steam compressor 28 and set the steam flow rate and the pressure. By properly setting the steam flow rate and the pressure, efficient operation of the steam compressor 28 is made possible.

Next, the operation to increase power output in this embodiment will be described. Conventionally, the nuclear reactor 2 is operated at the rated power (100%) in the operation cycle. While in this embodiment, the nuclear reactor power output is increased, e.g., up to 120%, thereby the nuclear reactor operation is conducted in such operation cycle. The operation to increase power output is to execute the operation of the nuclear reactor 2 by increasing the nuclear reactor power output up to 120%. This kind of increase in power output in the BWR nuclear power plant can be achieved, for example, by increasing the capacity of the recirculation pump and making the blades of the low-pressure turbines 5A, 5B, and 5C longer. The core flow rate can be increased from the conventional rated power of 100% to 120% by increasing the capacity of the recirculation pump. Therefore, in this embodiment, by controlling the core flow rate, it is possible to further increase nuclear reactor power output from the rated power of 100% to 120%. During the operation to increase power output, the steam compressed by the steam compressor 28 is supplied to the first high-pressure feed water heater 16A.

When the degree of moisture of the steam flowing through the steam feed pipe 31 located on the intake side of the steam compressor 28 is large, a mist separator may be installed in the steam feed pipe 31. Furthermore, when the degree of dryness of the steam is large, saturated steam is compressed on the discharge side of the steam compressor 28, causing a rapid temperature increase. To avoid this phenomenon, a spray of micro-droplets, i.e., mist spray, may be conducted in the steam feed pipe 32, thereby decreasing the level of overheating of the steam. It is possible to maintain an efficient operating condition of the steam compressor 28 by properly changing the steam condition. This embodiment applies the concept of the aforementioned Case C (see FIG. 7) in which the steam compressed by the steam compressor 28 is supplied to the first high-pressure feed water heater 16A. Obviously, if the steam extraction point at which steam supplied to the steam compressor 28 is extracted from the low-pressure turbine 5A is properly set, the steam compressed by the steam compressor 28 may be supplied to the second high-pressure feed water heater 16B installed upstream of the first high-pressure feed water heater 16A instead of supplying the steam to the first high-pressure feed water heater 16A.

In this embodiment, both the steam extracted from the high-pressure turbine 3 (extracted steam which does not pass through the steam compressor 28) and the steam whose pressure and temperature have been increased by each steam compressor 28 are used as a heat source for heating feed water in the first high-pressure feed water heater 16A.

Utilization of thermal energy in the conventional 1100 MWe BWR-5 type BWR nuclear power plant that is not equipped with a steam compression apparatus 27 will be described. This conventional BWR nuclear power plant has a configuration in which the steam compression apparatus 27 is removed from the configuration of the BWR nuclear power plant 1 according to this embodiment. In the conventional BWR nuclear power plant, steam flow in the main steam system including the main steam pipe 6, the high-pressure turbine 3, and the low-pressure turbines 5A, 5B, and 5C has been optimized so that maximum thermal efficiency can be obtained by the specified thermal power at the core. Specifically, when steam is condensed with the condenser 11 and becomes water, at the pressure (approximately 7 MPa) of the nuclear reactor 2, approximately two-thirds of the energy generated by the nuclear reactor 2 based on the principles of thermal cycle is discharged into the outer environment as warm waste water and the like from the condenser 11 into the sea 35. In order to effectively utilize the discharged energy, a portion of the steam generated by the nuclear reactor 2 is extracted from the high-pressure turbine 3 and the low-pressure turbines 5A, 5B and 5C, and is used to heat the feed water in each feed water heater in the BWR nuclear power plant 1 according to this embodiment. Because heat of the steam generated by the nuclear reactor 2 is recovered and temperature of the feed water supplied to the nuclear reactor 2 increases, thermal efficiency in the nuclear reactor 2 increases. In the BWR nuclear power plant 1 equipped with the moisture separator 4, of all the generated steam, the amount of steam converted into motive power in the high-pressure turbine 3 and the low-pressure turbines 5A, 5B and 5C, and finally discharged from the low-pressure turbine outlet into the condenser 11 is approximately 56%. The remaining steam of approximately 44% is used to heat the feed water in each feed water heater. Since the conventional BWR nuclear power plant is equipped with six feed water heaters as well, the amount of extracted steam per feed water heater averages approximately 7% of the steam discharged from the nuclear reactor 2. Meanwhile, in the conventional BWR nuclear power plant using an advanced BWR reactor (hereinafter, referred to as ABWR) equipped with a moisture separation reheater or a moisture separation superheater instead of the moisture separator 4, of all the steam generated by the nuclear reactor, the amount of steam finally supplied from the low-pressure turbine outlet to the condenser is approximately 54%. As shown above, in order to increase thermal efficiency in those conventional BWR nuclear power plants, it is generally known that performance can be increased due to reheat efficiency by replacing the moisture separator with the moisture separation superheater. However, particularly in the conventional BWR-5 type BWR nuclear power plant, because the container of the moisture separator is small, it is extremely difficult to install a large number of additional heat transfer pipes to create a superheater in this container.

In the BWR nuclear power plant 1, when operation to increase power output is conducted to further increase the rated power of the nuclear reactor, the flow rate of the steam discharged from the nuclear reactor 2 increases. Therefore, it is desirable that low-temperature and low-pressure steam used to rotate the generator 9 in the low-pressure turbines 5A, 5B, and 5C during operation to increase power output be used as much as possible to heat feed water for heat recovery without the steam being discharged into the condenser 11.

As stated above, in this embodiment provided with the steam compression apparatus 27, the steam compressed with the steam compressor 28 and the temperature of which has been increased is supplied to the first high-pressure feed water heater 16A to be used for heating feed water. Therefore, the temperature of feed water supplied to the nuclear reactor 2 is higher than the temperature of feed water used in the conventional BWR nuclear power plant. Due to the increase in feed water temperature, the amount of heat generated by nuclear fission in the nuclear reactor 2 can be effectively used for generating steam, thereby increasing the flow rate of the steam discharged from the nuclear reactor 2. Consequently, thermal efficiency in the BWR nuclear power plant 1 can be further increased.

Specifically, in this embodiment, both the steam extracted from the high-pressure turbine 3 and the steam compressed with the steam compressor 28 are used to heat feed water in the first high-pressure feed water heater 16A; therefore, the temperature increase rate of the steam compressed with the steam compressor 28 can be made smaller than the temperature increase rate of the steam compressed with the compressor described in Japanese utility model application publication No. Hei 1(1989)-123001. Thus, plant service power consumed by the steam compressor 28 to compress steam is less than the plant service power consumed by the compressor described in Japanese utility model application publication No. Hei 1(1989)-123001. This decrease in consumption of plant service power also contributes to the improvement of thermal efficiency in the BWR nuclear power plant 1. In addition, because the steam compressor 28 used in this embodiment is smaller than the compressor described in Japanese utility model application publication No. Hei 1(1989)-123001, the amount of consumed plant service power is small. Consequently, thermal efficiency in the BWR nuclear power plant 1 can be further increased.

Thermal efficiency in the BWR nuclear power plant 1 stated above is greater than the thermal efficiency in the BWR nuclear power plant 1 when operation to increase power output is conducted in the BWR nuclear power plant 1.

In this embodiment, because feed water is heated by the steam compressed with the steam compressor 28, temperature of warm waste water discharged from the condenser 11 into the sea through the seawater discharge pipe 13B can be decreased.

In this embodiment, the steam feed pipe 32 may be connected to the second high-pressure feed water heater 16B instead of connecting the pipe to the first high-pressure feed water heater 16A.

This embodiment can be applied to a 1350 MWe ABWR type BWR nuclear power plant. Each of the embodiments from second through seventh, eleventh, and twelfth embodiments (from FIGS. 9 to 14, 18, and 19), to be described later, can also be applied to the ABWR type BWR nuclear power plant.

Second Embodiment

An electric power plant according to a second embodiment which is another embodiment of the present invention will be described with reference to FIG. 9. The electric power plant in this embodiment is also an 1100 MWe BWR-5 type BWR nuclear power plant 1A. The BWR nuclear power plant 1A has a configuration in which the steam compression apparatus 27 of the BWR nuclear power plant 1 in the first embodiment is replaced by a steam compression apparatus 27A. The steam feed pipe 31 is connected to the steam extraction point 72 (second location). The other configuration of the BWR nuclear power plant 1A is the same as the configuration of the BWR nuclear power plant 1.

Figure 9:
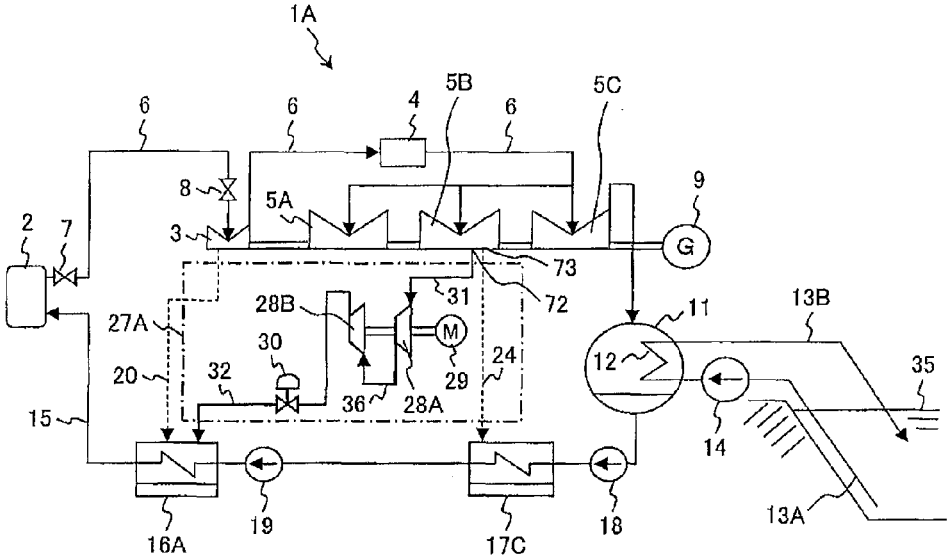
FIG. 9 is a configuration diagram of a BWR nuclear power plant according to a second embodiment that is another embodiment of the present invention.

In FIG. 9, feed water heaters other than the first high-pressure feed water heater 16A and the fifth low-pressure feed water heater 17C and extraction pipes other than the extraction pipes 20 and 24 are omitted. This is the same as in FIG. 10, FIG. 11, FIG. 15, FIG. 17, FIG. 18, and FIG. 19, to be described later.

The steam compression apparatus 27A is configured such that the steam compressor 28 used in the steam compression apparatus 27 is replaced by the steam compressors 28A and 28B, and the steam outlet of the steam compressor 28A is connected to the steam inlet of the steam compressor 28B via a pipe 36. The steam compressors 28A and 28B connected in series via the pipe 36 are coupled to the drive apparatus 29 via the common rotational axis. The steam feed pipe 31 connected to the steam extraction point 72 of the low-pressure turbine 5B is connected to the steam inlet of the steam compressor 28A. The steam feed pipe 32 provided with the control valve 30 is connected to the steam outlet of the steam compressor 28B and the first high-pressure feed water heater 16A. In this embodiment, the second pipe includes the steam feed pipes 31 and 32 and the pipe 36.

The steam extraction point 72 to which the extraction pipe 23 is connected and the steam extraction point 72 to which the steam feed pipe 31 is connected are separated from each other in the circumferential direction of the low-pressure turbine 5B at locations on the same stage of the stator blades provided in the low-pressure turbine 5B.

The function of the steam compression apparatus 27A different from the first embodiment will be described. Steam extracted from the steam extraction point 72 of the low-pressure turbine 5B is supplied to the steam compressor 28A through the steam feed pipe 31 and compressed with the steam compressor 28A, increasing the steam temperature. The steam compressed with the steam compressor 28A is supplied to the steam compressor 28B through the pipe 36. The steam is compressed with the steam compressor 28B and the temperature further increases. The compressed steam discharged from the steam compressor 28B is supplied to the first high-pressure feed water heater 16A through the steam feed pipe 32. This compressed steam is also used together with the steam extracted from the high-pressure turbine 3 to heat feed water in the first high-pressure feed water heater 16A.

The steam compression apparatus (steam heat pump) 27A is also provided for each of the low-pressure turbines 5A and 5C. The steam compression apparatus 27A provided for the low-pressure turbine 5A compresses steam extracted from the steam extraction point 72 of the low-pressure turbine 5A and supplies the steam to the first high-pressure feed water heater 16A. The steam compression apparatus 27A provided for the low-pressure turbine 5C compresses steam extracted from the steam extraction point 72 of the low-pressure turbine 5C and supplies the steam to the first high-pressure feed water heater 16A.

Because the BWR nuclear power plant 1A in this embodiment uses a steam compression apparatus 27A equipped with steam compressors 28A and 28B in which steam is supplied in series, it is possible to increase the pressure increase rate of the compressed steam (steam compression ratio) when compared with the pressure increase rate of the steam compression apparatus 27. Therefore, it is possible to supply steam, which is extracted from the steam extraction point 72 of the low-pressure turbine 5B and the pressure of which is lower than the steam in the first embodiment, to the first high-pressure feed water heater 16A with the steam compression apparatus 27A. The BWR nuclear power plant 1A equipped with the steam compression apparatus 27A can also obtain all of the effects that can be obtained from the BWR nuclear power plant 1 according to the first embodiment.

It is also possible to couple each rotational axis of the steam compressors 28A and 28B separately to the rotational axis of the drive apparatus 29 using an overdrive gear. This configuration enables a further reduction in the electric power consumed by the drive apparatus 29.

Instead of connecting the steam feed pipe 32 to the first high-pressure feed water heater 16A, the steam feed pipe 32 connected to the steam compressor 28B may be connected either to the second high-pressure feed water heater 16B or to the third low-pressure feed water heater 17A, and the compressed steam may be supplied to the feed water heater to which the steam feed pipe 32 is connected.

Instead of connecting the steam feed pipe 31 to the steam extraction point 72 of the low-pressure turbine 5B, the steam feed pipe 31 may be connected to the moisture separator 4, and the steam extracted from the moisture separator 4 may be supplied to the steam compressors 28A and 28B.

Third Embodiment

Figure 10:
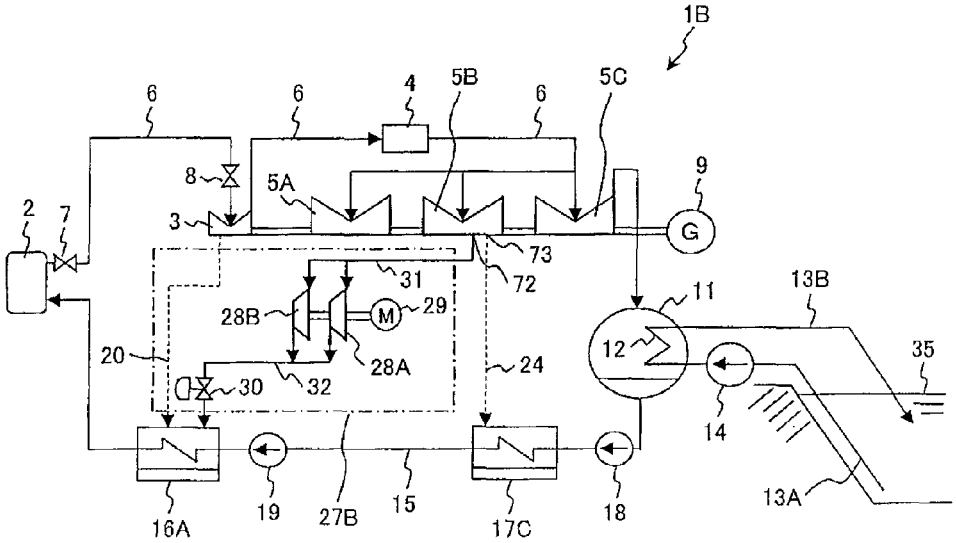
FIG. 10 is a configuration diagram of a BWR nuclear power plant according to a third embodiment that is still another embodiment of the present invention.

An electric power plant according to a third embodiment which is another embodiment of the present invention will be described with reference to FIG. 10. The electric power plant in this embodiment is also an 1100 MWe BWR-5 type BWR nuclear power plant 1B. The BWR nuclear power plant 1B has a configuration in which the steam compression apparatus 27 of the BWR nuclear power plant 1 in the first embodiment is replaced by a steam compression apparatus 27B. The steam feed pipe 31 is connected to the steam extraction point 72. The other configuration of the BWR nuclear power plant 1B is the same as the configuration of the BWR nuclear power plant 1.

The steam compression apparatus 27B is configured such that the steam compressor 28 used in the steam compression apparatus 27 is replaced by the steam compressors 28A and 28B. The steam compressors 28A and 28B are coupled to the drive apparatus 29 via the common rotational axis. The steam feed pipe 31 connected to the steam extraction point 72 of the low-pressure turbine 5B is connected to each steam inlet of the steam compressors 28A and 28B. The steam feed pipe 32 provided with the control valve 30 is connected to each steam outlet of the steam compressors 28A and 28B and the first high-pressure feed water heater 16A. The steam compressors 28A and 28B are connected to the steam feed pipes 31 and 32 in parallel.

The steam extraction point 72 to which the extraction pipe 23 is connected and the steam extraction point 72 to which the steam feed pipe 31 is connected are separated from each other in the circumferential direction of the low-pressure turbine 5B at locations on the same stage of the stator blades provided in the low-pressure turbine 5B.

The function of the steam compression apparatus 27B different from the first embodiment will be described. Steam extracted from the steam extraction point 72 of the low-pressure turbine 5B is supplied to the steam compressors 28A and 28B through the steam feed pipe 31 and compressed with each steam compressor, increasing the steam temperature. The steam compressed with the steam compressors 28A and 28B is supplied to the first high-pressure feed water heater 16A through the steam feed pipe 32. This compressed steam is also used together with the steam extracted from the high-pressure turbine 3 to heat feed water in the first high-pressure feed water heater 16A.

The steam compression apparatus (steam heat pump) 27B is also provided for each of the low-pressure turbines 5A and 5C. The steam compression apparatus 27B provided for the low-pressure turbine 5A compresses steam extracted from the steam extraction point 72 of the low-pressure turbine 5A and supplies the steam to the first high-pressure feed water heater 16A. The steam compression apparatus 27B provided for the low-pressure turbine 5C compresses steam extracted from the steam extraction point 72 of the low-pressure turbine 5C and supplies the steam to the first high-pressure feed water heater 16A.

This embodiment can increase the flow rate of the compressed steam supplied to the first high-pressure feed water heater 16A more than the first embodiment. This embodiment can also obtain all of the effects that can be obtained from the BWR nuclear power plant 1 according to the first embodiment.

Instead of connecting the steam feed pipe 32 to the first high-pressure feed water heater 16A, the steam feed pipe 32 connected to the steam compressors 28A and 28B may be connected either to the second high-pressure feed water heater 16B or to the third low-pressure feed water heater 17A, and the compressed steam may be supplied to the feed water heater to which the steam feed pipe 32 is connected.

Fourth Embodiment

Figure 11:
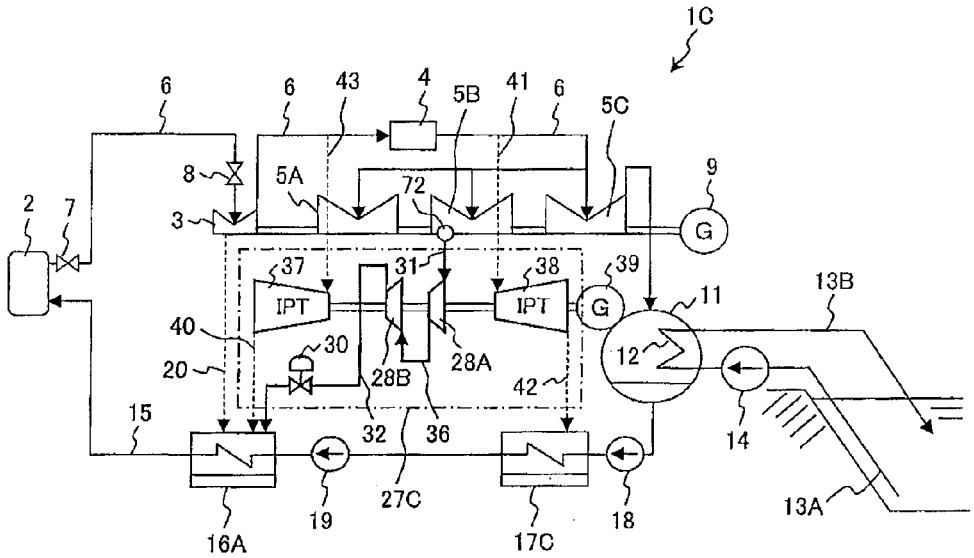
FIG. 11 is a configuration diagram of a BWR nuclear power plant according to a fourth embodiment that is still another embodiment of the present invention.

An electric power plant according to a fourth embodiment which is another embodiment of the present invention will be described with reference to FIG. 11. The electric power plant in this embodiment is also an 1100 MWe BWR-5 type BWR nuclear power plant 1C. The BWR nuclear power plant 1C has a configuration in which the steam compression apparatus 27A of the BWR nuclear power plant 1A in the second embodiment is replaced by a steam compression apparatus 27C. The other configuration of the BWR nuclear power plant 1C is the same as the configuration of the BWR nuclear power plant 1A.

The steam compression apparatus 27C has a configuration in which the drive apparatus 29 of the steam compression apparatus 27A is replaced by turbines 37 and 38. The other configuration of the steam compression apparatus 27C is the same as the configuration of the steam compression apparatus 27A. Medium-pressure turbines 37 and 38 are coupled to the rotational axis commonly connected to the steam compressors 28A and 28B. A generator 39 is connected to the turbine 38. The turbine 37 is connected by the extraction pipe 43 to the main steam pipe 6 located between the high-pressure turbine 3 and the moisture separator 4 and is connected to the first high-pressure feed water heater 16A by the steam discharge pipe 40. The turbine 38 is connected by the extraction pipe 41 to the main steam pipe 6 located between the moisture separator 4 and the low-pressure turbine and is connected to the fifth low-pressure feed water heater 17C by the steam discharge pipe 42. The fifth low-pressure feed water heater 17C is connected to the steam extraction point 73 (not shown) of the low-pressure turbine 5B by the extraction pipe 24 (not shown).

In the steam compression apparatus 27C, the steam compressors 28A and 28B are rotated by the drive of the turbines 37 and 38. The turbine 37 is driven by steam extracted from the main steam pipe 6 and supplied through the extraction pipe 43. The steam discharged from the turbine 37 is supplied to the barrel of the first high-pressure feed water heater 16A through the steam discharge pipe 40. The turbine 38 is driven by steam extracted from the main steam pipe 6 and supplied through the extraction pipe 41. The steam discharged from the turbine 38 is supplied to the barrel of the fifth low-pressure feed water heater 17C through the steam discharge pipe 42. Steam compression in the steam compression apparatus 27C is conducted in the same manner as the steam compression apparatus 27A. The steam compressed with the steam compressors 28A and 28B is supplied to the first high-pressure feed water heater 16A.

The steam compression apparatus (steam heat pump) 27C is also provided for each of the low-pressure turbines 5A and 5C. The steam discharged from the turbine 37 provided for the low-pressure turbine 5A is supplied to the barrel of the first high-pressure feed water heater 16A through the steam discharge pipe 40. The steam discharged from the turbine 38 provided for the low-pressure turbine 5A is supplied to the barrel of the fifth low-pressure feed water heater 17C provided for the low-pressure turbine 5A through the steam discharge pipe 42. The steam discharged from the turbine 37 provided for the low-pressure turbine 5C is supplied to the barrel of the first high-pressure feed water heater 16A through the steam discharge pipe 40. The steam discharged from the turbine 38 provided for the low-pressure turbine 5C is supplied to the barrel of the fifth low-pressure feed water heater 17C provided for the low-pressure turbine 5C through the steam discharge pipe 42.

This embodiment can also obtain all of the effects that can be obtained from the BWR nuclear power plant 1A according to the second embodiment. In this embodiment, the steam compressors 28A and 28B are rotated with turbines 37 and 38 without using a drive apparatus 29. Therefore, this embodiment can reduce the amount of consumed plant service power when compared with the second embodiment, and can increase thermal efficiency in the BWR nuclear power plant 1C more than the thermal efficiency in the BWR nuclear power plant 1A. The turbines 37 and 38 driven by the extracted steam rotate the generator 39, thereby generating electric power. Consequently, thermal efficiency in the BWR nuclear power plant 1C can be further increased. The steam discharged from the turbines 37 and 38 is used to heat feed water in the first high-pressure feed water heater 16A and the fifth low-pressure feed water heater 17C, accordingly, thermal efficiency can be further increased. Moreover, when the steam compressors 28A and 28B are centrifugal steam compressors, unstable rotation that could occur due to an overhang condition because loads including a rotational load that are exerted on one side can be prevented by installing the turbines 37 and 38 on both sides.

In the steam compression apparatus 27C, the steam compressors 28A and 28B may be connected to the steam feed pipes 31 and 32 in the same manner as the steam compression apparatus 27B.

Fifth Embodiment

Figure 12:
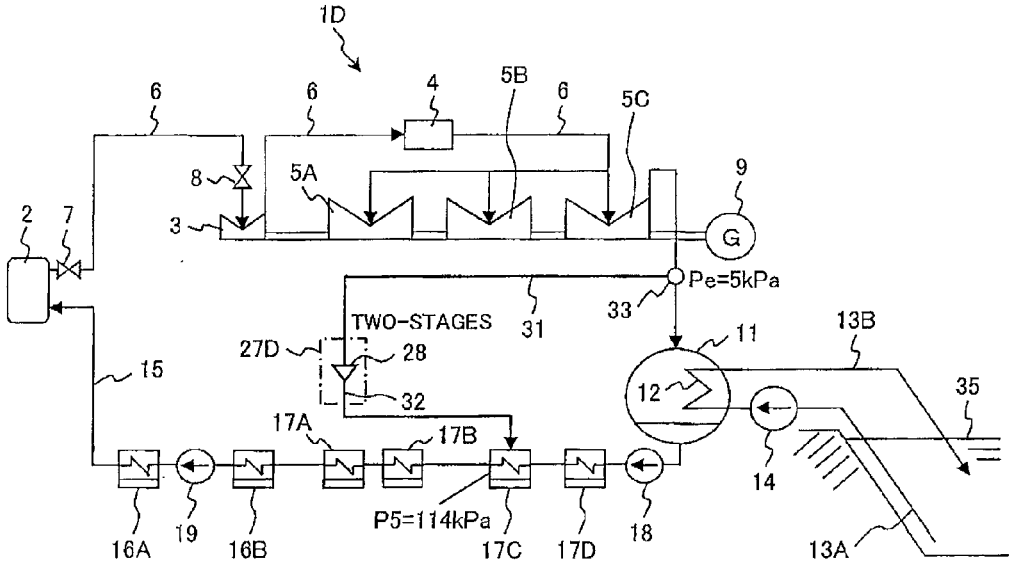
FIG. 12 is a configuration diagram of a BWR nuclear power plant according to a fifth embodiment that is still another embodiment of the present invention.
Figure 13:
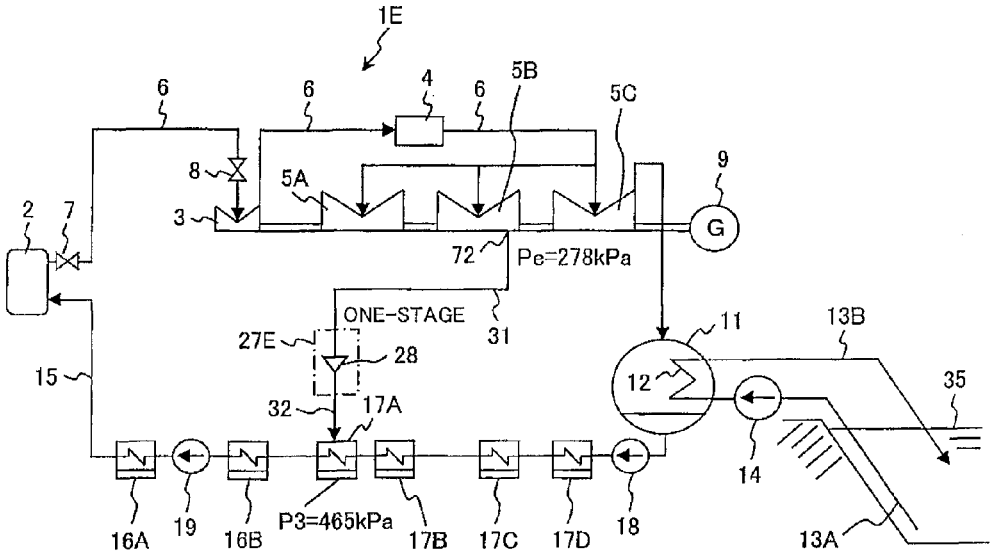
FIG. 13 is a configuration diagram of a BWR nuclear power plant according to a sixth embodiment that is still another embodiment of the present invention.

An electric power plant according to a fifth embodiment which is another embodiment of the present invention will be described with reference to FIG. 12. The electric power plant in this embodiment is also an 1100 MWe BWR-5 type BWR nuclear power plant 1D. The BWR nuclear power plant 1D has a configuration in which the steam compression apparatus 27A of the BWR nuclear power plant 1A in the second embodiment is replaced by a steam compression apparatus 27D. The other configuration of the BWR nuclear power plant 1D is the same as the configuration of the BWR nuclear power plant 1A. In FIG. 12, extraction pipes 20 to 25 and a drainage water pipe 26 are omitted. In FIG. 13 to be illustrated later, those pipes are also omitted.

In the same manner as the steam compression apparatus 27A, the steam compression apparatus 27D is also equipped with two-stage steam compressors 28 connected in series. The steam inlet of the first-stage steam compressor 28 is connected to the steam feed pipe 31. The steam feed pipe 31 directs steam discharged from the low-pressure turbine 5B to the condenser 11 from the steam extraction point 33 to the first-stage steam compressor 28. The steam feed pipe 32 connected to the steam outlet of the second-stage steam compressor 28 is connected to the fifth low-pressure feed water heater 17C. In the steam compressor 28 on each stage from the first-stage steam compressor 28 to the second-stage steam compressor 28, the steam outlet of one of the adjacent steam compressors 28 is connected to the steam inlet of the other steam compressor 28 via the pipe 36.

Steam having a pressure Pe of 5 kPa discharged from the low-pressure turbine flows into the steam feed pipe 31 from the steam extraction point 33, is directed to the first-stage steam compressor 28, and compressed. After that, the steam is compressed with the second-stage steam compressor 28, supplied through the steam feed pipe 32 to the fifth low-pressure feed water heater 17C, and then used to heat the feed water. The steam extracted from the low-pressure turbine 5B is supplied through the extraction pipe 24 to the fifth low-pressure feed water heater 17C to heat the feed water. Because this embodiment compresses steam with two steam compressors 28, the steam pressure can be increased from 5 kPa to 114 kPa required for the steam to be supplied to the fifth low-pressure feed water heater 17C. At this time, the COP of the steam compressor is 3.7. This embodiment can also obtain all of the effects that can be obtained by the second embodiment.

When connecting the steam feed pipe 32 to the sixth low-pressure feed water heater 17D and supplying the steam compressed with the steam compression apparatus 27D to the sixth low-pressure feed water heater 17D to which the extraction pipe 25 is connected, in the steam compression apparatus 27D, the steam pressure may be increased by one steam compressor 28 from 5 kPa to 40 kPa required for the steam to be supplied to the sixth low-pressure feed water heater 17D. At this time, the COP of the steam compressor is 6.

Efficient operation of the BWR nuclear power plant is possible by selecting the number of steam compressors in accordance with the conditions of the feed water heaters to which the compressed steam is supplied.

Sixth Embodiment

An electric power plant according to a sixth embodiment which is another embodiment of the present invention will be described with reference to FIG. 13. The electric power plant in this embodiment is also an 1100 MWe BWR-5 type BWR nuclear power plant 1E. The BWR nuclear power plant 1E has a configuration in which the steam compression apparatus 27A of the BWR nuclear power plant 1A in the second embodiment is replaced by a steam compression apparatus 27E. The other configuration of the BWR nuclear power plant 1E is the same as the configuration of the BWR nuclear power plant 1A.

When connecting the steam feed pipe 32 to the third low-pressure feed water heater 17A and supplying the steam compressed with the steam compression apparatus 27E to the third low-pressure feed water heater 17A, one steam compressor 28 is provided in the steam compression apparatus 27E and the steam pressure may be increased from 278 kPa to 465 kPa required for the steam to be supplied to the third low-pressure feed water heater 17A. At this time, the COP of the steam compressor is 16.

The steam compression apparatus 27E is equipped with one steam compressor 28. The steam inlet of the steam compressor 28 is connected to the steam feed pipe 31 connected to the steam extraction point 72 of the low-pressure turbine 5B. The steam feed pipe 32 connected to the steam outlet of the steam compressor 28 is connected to the third low-pressure feed water heater 17A.

Steam having a pressure Pe of 278 kPa extracted from the steam extraction point 72 (second location) of the low-pressure turbine 5B flows into the steam feed pipe 31 from the steam extraction point 72, is directed to the steam compressor 28, and compressed. After that, the steam discharged from the steam compressor 28 is supplied to the third low-pressure feed water heater 17A through the steam feed pipe 32 and used to heat the feed water. In order to heat the feed water, to the third low-pressure feed water heater 17A, the steam extracted from the steam extraction point 71 (first location) of the low-pressure turbine 5B is supplied through the extraction pipe 22, and also the saturated drainage water discharged from the moisture separator 4 is supplied through the drainage water pipe 26. Because this embodiment compresses steam by one steam compressor 28, the steam pressure can be increased from 278 kPa to 465 kPa required for the steam to be supplied to the third low-pressure feed water heater 17A.

The steam compression apparatus (steam heat pump) 27E is also provided for each of the low-pressure turbines 5A and 5C. The steam compression apparatus 27E provided for the low-pressure turbine 5A compresses the steam extracted from the steam extraction point 72 of the low-pressure turbine 5A and supplies the steam to the third low-pressure feed water heater 17A provided for the low-pressure turbine 5A. The steam compression apparatus 27 provided for the low-pressure turbine 5C compresses the steam extracted from the steam extraction point 72 of the low-pressure turbine 5C and supplies the steam to the third low-pressure feed water heater 17A provided for the low-pressure turbine 5C.

This embodiment can also obtain all of the effects that can be obtained by the second embodiment.

When connecting the steam feed pipe 32 to the first high-pressure feed water heater 16A and supplying the steam compressed with the steam compression apparatus 27E to the first high-pressure feed water heater 16A, in the steam compression apparatus 27E, the steam pressure can be increased with one steam compressor 28 from 278 kPa to 2.36 MPa required for the steam to be supplied to the first high-pressure feed water heater 16A. At this time, the COP of the steam compressor is 8.5.

When connecting the steam feed pipe 32 to the second high-pressure feed water heater 16B and supplying the steam compressed by the steam compression apparatus 27E to the second high-pressure feed water heater 16B to which the extraction pipe 21 is connected, in the steam compression apparatus 27E, the steam pressure can be increased with one steam compressor 28 from 278 kPa to 1.4 MPa required for the steam to be supplied to the second high-pressure feed water heater 16B. At this time, the COP of the steam compressor is 5.3.

Seventh Embodiment

Figure 14:
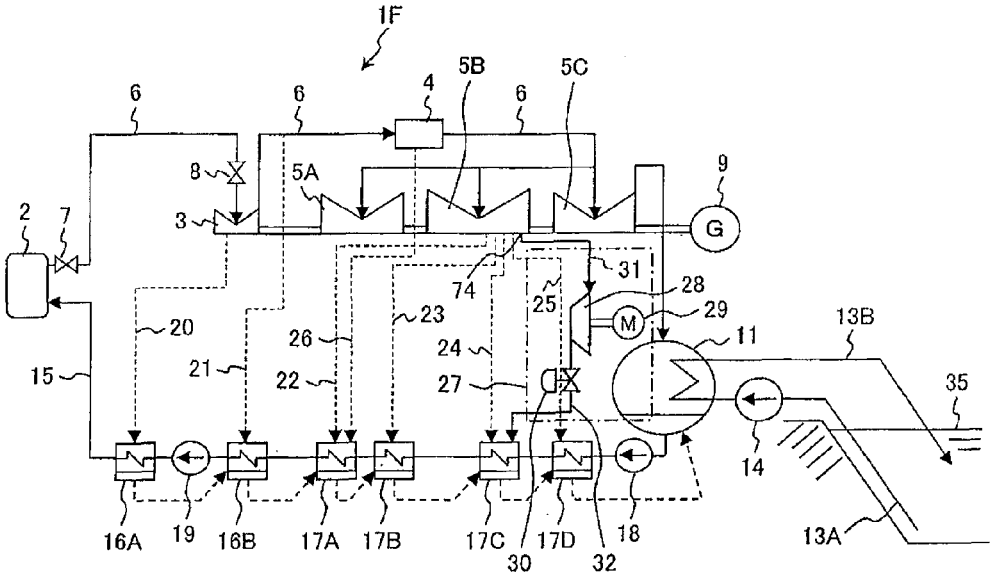
FIG. 14 is a configuration diagram of a BWR nuclear power plant according to a seventh embodiment that is still another embodiment of the present invention.

An electric power plant according to a seventh embodiment which is another embodiment of the present invention will be described with reference to FIG. 14. The electric power plant in this embodiment is also an 1100 MWe BWR-5 type BWR nuclear power plant 1F. The BWR nuclear power plant 1F is configured such that the steam feed pipe 31 of the steam compression apparatus 27 is connected to the low-pressure turbine 5B, and the steam feed pipe 32 of the steam compression apparatus 27 is connected to the fifth low-pressure feed water heater 17C in the BWR nuclear power plant 1 in the first embodiment. The steam feed pipe 31 is connected to the steam extraction point 74 (second location). The other configuration of the BWR nuclear power plant 1F is the same as the configuration of the BWR nuclear power plant 1.

The steam extraction point 74 to which the extraction pipe 25 is connected and the steam extraction point 74 to which the steam feed pipe 31 is connected are separated from each other in the circumferential direction of the low-pressure turbine 5B at locations on the same stage of the stator blades provided in the low-pressure turbine 5B.

In the BWR nuclear power plant 1F, the steam extracted from the steam extraction point 74 of the low-pressure turbine 5B is compressed with the steam compressor 28, supplied to the fifth low-pressure feed water heater 17C where the steam heats the feed water. The steam extracted from the steam extraction point 73 (first location) of the low-pressure turbine 5B is supplied to the fifth low-pressure feed water heater 17C through the extraction pipe 24.

The steam compression apparatus (steam heat pump) 27 is also provided for each of the low-pressure turbines 5A and 5C. The steam compression apparatus 27 provided for the low-pressure turbine 5A compresses the steam extracted from the steam extraction point 74 of the low-pressure turbine 5A and supplies the steam to the fifth low-pressure feed water heater 17C provided for the low-pressure turbine 5A. The steam compression apparatus 27 provided for the low-pressure turbine 5C compresses the steam discharged from the steam extraction point 74 of the low-pressure turbine 5C and supplies the steam to the fifth low-pressure feed water heater 17C provided for the low-pressure turbine 5C.

This embodiment can also obtain all of the effects that can be obtained by the first embodiment.

Instead of connecting the steam feed pipe 32 to the fifth low-pressure feed water heater 17C, the steam feed pipe 32 may be connected either to the third low-pressure feed water heater 17A or to the fourth low-pressure feed water heater 17B.

Eighth Embodiment

Figure 15:
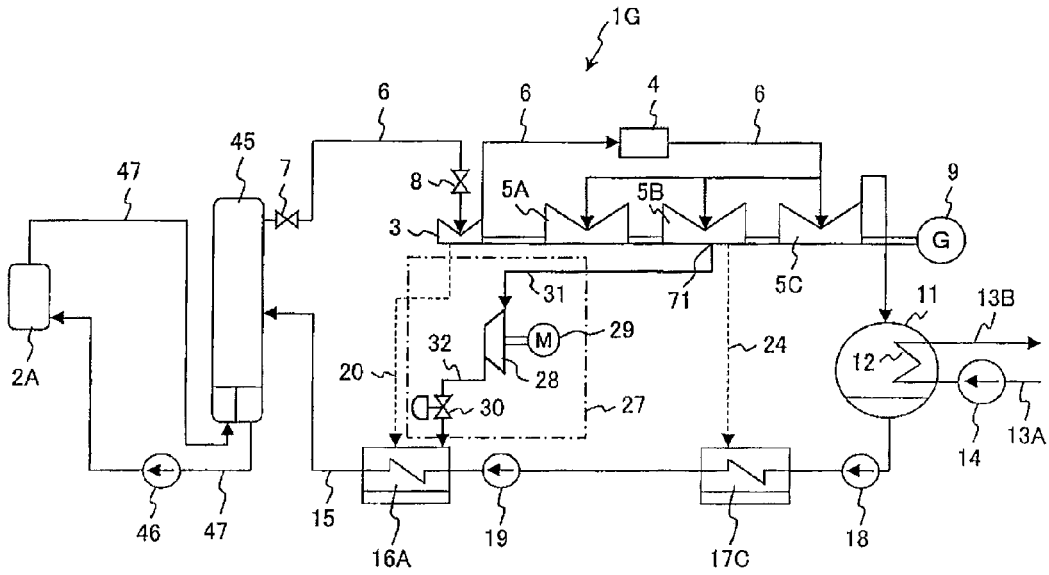
FIG. 15 is a configuration diagram of a BWR nuclear power plant according to an eighth embodiment that is still another embodiment of the present invention.

An electric power plant according to an eighth embodiment which is another embodiment of the present invention will be described with reference to FIG. 15. Unlike the BWR nuclear power plants to which the first to seventh embodiments are applied, the electric power plant in this embodiment is a pressurized water reactor (PWR) nuclear power plant that is one type of the nuclear power plants.

The PWR nuclear power plant 1G in this embodiment is equipped with: a nuclear reactor 2A; a steam generator (steam generating apparatus) 45; a primary cooling system pipe 47; the main steam system and the feed water system used in the BWR nuclear power plant 1; and the steam compression apparatus 27. The main steam system includes: the high-pressure turbine 3; the low-pressure turbines 5A, 5B and 5C; the main steam pipe 6; the moisture separator 4; and the condenser 11 shown in FIG. 1. The feed water system includes: the feed water pipe 15; the high-pressure feed water heaters 16A and 16B; the low-pressure feed water heaters 17A to 17D; the extraction pipes 20 to 25; and the drainage pipe 26.

The steam generator 45 is connected to the nuclear reactor 2A by the primary cooling system pipe 47 forming a circulation loop of cooling water. A circulation pump 46 is provided for the primary cooling system pipe 47. The main steam pipe 6 and the feed water pipe 15 are connected to the steam generator 45. The steam compressor 28 of the steam compression apparatus 27 is connected to the low-pressure turbine 5B via the steam feed pipe 31 and also connected to the first high-pressure feed water heater 16A via the steam feed pipe 32.

High-temperature cooling water heated in the core of the nuclear reactor 2A is supplied by driving the circulation pump 46 to a plurality of heat transfer pipes (not shown) installed in the barrel of the steam generator 45 through the primary cooling system pipe 47. In the barrel of the steam generator 45, this high-temperature cooling water heats the feed water supplied to the outside of the heat transfer pipes. Feed water is supplied from the feed water pipe 15, heated by the high-temperature cooling water, and becomes steam. After heating the feed water, the temperature of the cooling water decreases, and the cooling water is returned to the nuclear reactor 2A through the primary cooling system pipe 47.

In the same manner as the BWR nuclear power plant 1, steam generated in the steam generator 45 is supplied to the high-pressure turbine 3 and the low-pressure turbines 5A, 5B, and 5C through the main steam pipe. The steam discharged from the low-pressure turbines is condensed with the condenser 11 and becomes water. In the same manner as the BWR nuclear power plant 1, this water, used as feed water, is sequentially heated, while flowing through the feed water pipe 15, with the sixth low-pressure feed water heater 17D, fifth low-pressure feed water heater 17C, fourth low-pressure feed water heater 17B, third low-pressure feed water heater 17A, second high-pressure feed water heater 16B, and the first high-pressure feed water heater 16A. Thus, the feed water temperature is increased, and when the set temperature is reached, the feed water is supplied to the steam generator 45.

In this embodiment, in the same manner as the BWR nuclear power plant 1, the steam extracted from the steam extraction point 71 of the low-pressure turbine 5B is compressed with the steam compressor 28 and supplied to the first high-pressure feed water heater 16A. The feed water supplied to the first high-pressure feed water heater 16A is heated by both the compressed steam and the steam extracted from the steam high-pressure turbine 3. The steam extraction point 71 to which the extraction pipe 22 is connected and the steam extraction point 71 to which the steam feed pipe 31 is connected are separated from each other in the circumferential direction of the low-pressure turbine 5B at locations on the same stage of the stator blades provided in the low-pressure turbine 5B.

The steam compression apparatus (steam heat pump) 27 is also provided for each of the low-pressure turbines 5A and 5C. The steam compression apparatus 27 provided for the low-pressure turbine 5A compresses the steam extracted from the steam extraction point 71 of the low-pressure turbine 5A and supplies the steam to the first high-pressure feed water heater 16A. The steam compression apparatus 27 provided for the low-pressure turbine 5C compresses the steam discharged from the steam extraction point 71 of the low-pressure turbine 5C and supplies the steam to the first high-pressure feed water heater 16A.

An increase in power output in this embodiment is made possible by increasing the length of the rotor blades of the low-pressure turbines 5A, 5B, and 5C. Therefore, low-pressure turbines 5A, 5B, and 5C equipped with longer rotor blades than the conventional models are used. Furthermore, the steam generator 45 having a larger heat transfer area than the conventional models is used. By doing so, an increase in power output is made possible.

This embodiment can also obtain all of the effects that can be obtained by the first embodiment.

In this embodiment as well, in the same manner as the BWR nuclear power plant, any one of the steam compression apparatuses 27A, 27B, 27C, 27D, and 27E can be used.

Ninth Embodiment 9

Figure 16:
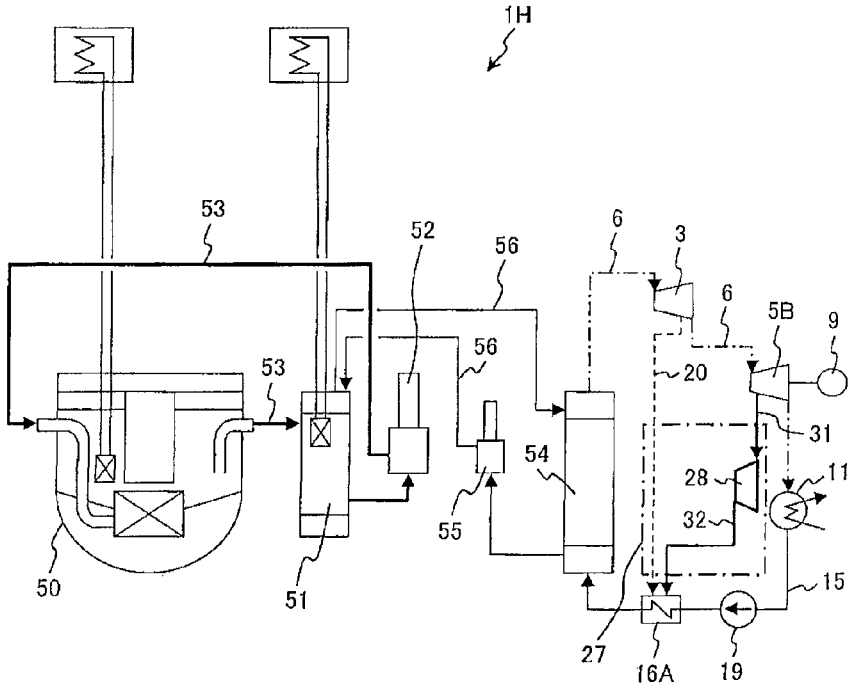
FIG. 16 is a configuration diagram of a BWR nuclear power plant according to a ninth embodiment that is still another embodiment of the present invention.

An electric power plant according to a ninth embodiment which is another embodiment of the present invention will be described with reference to FIG. 16. The electric power plant in this embodiment is a fast breeder reactor (FBR) nuclear power plant that is one type of the nuclear power plants.

The FBR nuclear power plant 1H in this embodiment is equipped with: an FBR 50; an intermediate heat exchanger 51; a primary circulation pump 52; a primary cooling system pipe 53; a steam generator (steam generating apparatus) 54; a secondary circulation pump 55; a secondary cooling system pipe 56; the main steam system and the feed water system used in the BWR nuclear power plant 1; and the steam compression apparatus 27. The main steam system includes: the high-pressure turbine 3; the low-pressure turbines 5A, 5B and 5C; the main steam pipe 6; the moisture separator 4; and the condenser 11 shown in FIG. 1. The feed water system includes: the feed water pipe 15; the high-pressure feed water heaters 16A and 16B; the low-pressure feed water heaters 17A to 17D; the extraction pipes 20 to 25; and the drainage pipe 26 shown in FIG. 1. In FIG. 16, the feed water heaters other than the low-pressure turbines 5A and 5C and the first high-pressure feed water heater 16A, the extraction pipes other than the extraction pipe 20, and the drainage pipe 26 provided in the main steam system and the feed water system (see FIG. 1) of the BWR nuclear power plant 1 are omitted.

The primary cooling system pipe 53 sequentially connects: the FBR 50; the intermediate heat exchanger 51; the primary circulation pump 52; and the FBR 50, thereby primary system coolant (e.g., liquid sodium) forms a closed-loop of the primary cooling system. The secondary cooling system pipe 56 sequentially connects: the intermediate heat exchanger 51; the steam generator 54; the secondary circulation pump 55; and the intermediate heat exchanger 51, thereby forming a closed-loop of the secondary cooling system. The main steam pipe 6 and the feed water pipe 15 are connected to the steam generator 54. The steam compressor 28 of the steam compression apparatus 27 is connected to the low-pressure turbine 5B via the steam feed pipe 31 and also connected to the first high-pressure feed water heater 16A via the steam feed pipe 32.

The primary system coolant (e.g., liquid sodium) heated in the core of the FBR 50 is directed by driving the primary circulation pump 52 to the intermediate heat exchanger 51 through the primary cooling system pipe 53. In the intermediate heat exchanger 51, the high-temperature primary system coolant heats the secondary system coolant (e.g., liquid sodium) supplied from the secondary cooling system pipe 56. The primary system coolant, the temperature of which has decreased, is returned to the FBR 50. Driving the secondary circulation pump 55 directs the secondary system coolant heated with the intermediate heat exchanger 51 to the steam generator 54 through the secondary cooling system pipe 56. Feed water supplied from the feed water pipe 15 is heated by the secondary system coolant in the steam generator 54 and becomes steam.

In the same manner as the BWR nuclear power plant 1, the steam generated in the steam generator 54 is supplied to the high-pressure turbine 3 and the low-pressure turbines 5A, 5B, and 5C through the main steam pipe. The steam discharged from the low-pressure turbines is condensed with the condenser 11 and becomes water. In the same manner as the BWR nuclear power plant 1, this water, used as feed water, is sequentially heated, while flowing through the feed water pipe 15, with the sixth low-pressure feed water heater 17D, fifth low-pressure feed water heater 17C, fourth low-pressure feed water heater 17B, third low-pressure feed water heater 17A, second high-pressure feed water heater 16B, and the first high-pressure feed water heater 16A. Thus, the feed water temperature is increased, and when the set temperature is reached, the feed water is supplied to the steam generator 54.

In the same manner as the BWR nuclear power plant 1, in this embodiment as well, the steam extracted from the steam extraction point 71 of the low-pressure turbine 5B is compressed with the steam compressor 28 and supplied to the first high-pressure feed water heater 16A. The feed water supplied to the first high-pressure feed water heater 16A is heated by both the compressed steam and the steam extracted from the steam extraction point of the high-pressure turbine 3.

In the same manner as the eighth embodiment, an increase in the power output in this embodiment is made possible by using low-pressure turbines 5A, 5B, and 5C equipped with longer rotor blades than the conventional models and also using the steam generator 54 having a larger heat transfer area than the conventional models.

This embodiment can also obtain all of the effects that can be obtained by the first embodiment.

In this embodiment as well, in the same manner as the BWR nuclear power plant, any one of the steam compression apparatuses 27A, 27B, 27C, 27D, and 27E can be used.

Tenth Embodiment

Figure 17:
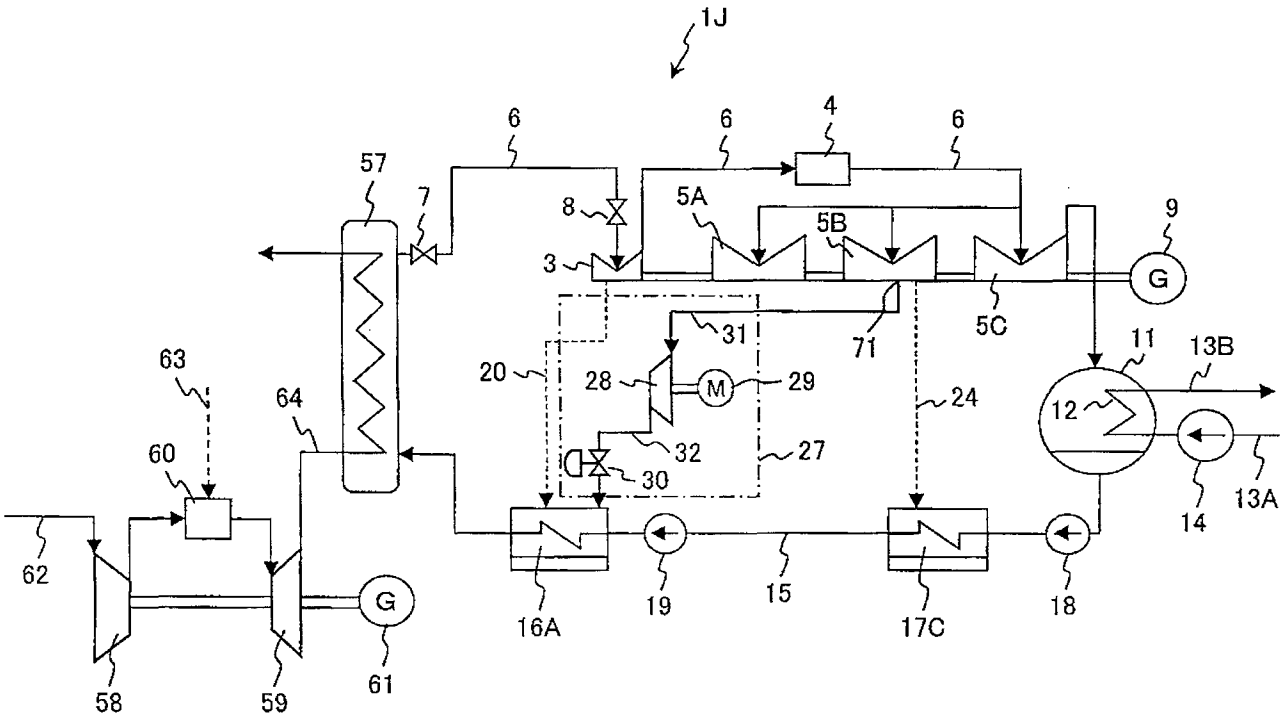
FIG. 17 is a configuration diagram of a BWR nuclear power plant according to a tenth embodiment that is still another embodiment of the present invention.

An electric power plant according to a tenth embodiment which is another embodiment of the present invention will be described with reference to FIG. 17. Unlike the BWR nuclear power plants to which the first to ninth embodiments are applied, the electric power plant in this embodiment is a thermal power plant, in particular, a combined thermal power plant 1J.

The combined thermal power plant 1J is equipped with a gas turbine power plant and a steam power plant. The gas turbine power plant includes: a compressor 58; a gas turbine 59; a combustor 60; and a generator 61. The compressor 58, gas turbine 59, and the generator 61 are coupled together via a uniaxial rotational axis. A combustion air pipe 62 is connected to the air inlet of the compressor 58 and the air outlet of the compressor 58 is connected to the combustor 60. The combustor 60 is connected to the gas turbine 59 via a pipe. The steam power plant has a configuration in which the nuclear reactor 2 of the BWR nuclear power plant 1 in the first embodiment is replaced by a steam generator (steam generating apparatus) 57. The main steam pipe 6 and the feed water pipe 15 are connected to the steam generator 57. An exhaust gas pipe 64 connected to the exhaust gas discharge port of the gas turbine 59 is connected to the steam generator 57.

Combustion air supplied from the combustion air pipe 62 is compressed with the compressor 58 and supplied to the combustor 60. Fuel supplied from a fuel feed pipe 63 to the combustor 60 is combusted in the combustor 60. The generated high-temperature and high-pressure combustion gas is supplied to the gas turbine 59, rotating the gas turbine 59. The generator 61 also rotates, generating electric power. The high-temperature exhaust gas discharged from the gas turbine 59 is directed to the steam generator 57 through an exhaust gas pipe 64 and is used to heat feed water supplied to the steam generator 57 through the feed water pipe 15. This feed water is heated and becomes steam. The steam generated in the steam generator 57 is supplied to the high-pressure turbine 3 and the low-pressure turbines 5A, 5B, and 5C through the main steam pipe in the same manner as the BWR nuclear power plant 1. The steam discharged from the low-pressure turbines is condensed with the condenser 11 and becomes water. In the same manner as the BWR nuclear power plant 1, this water, used as feed water, is sequentially heated, while flowing through the feed water pipe 15, with the sixth low-pressure feed water heater 17D, fifth low-pressure feed water heater 17C, fourth low-pressure feed water heater 17B, third low-pressure feed water heater 17A, second high-pressure feed water heater 16B, and the first high-pressure feed water heater 16A. Thus, the feed water temperature is increased, and when the set temperature is reached, the feed water is supplied to the steam generator 57.

In the same manner as the BWR nuclear power plant 1, in this embodiment as well, the steam extracted from the steam extraction point 71 (second location) of the low-pressure turbine 5B is compressed with the steam compressor 28 of the steam compression apparatus 27 and supplied to the first high-pressure feed water heater 16A. The feed water supplied to the first high-pressure feed water heater 16A is heated by both the compressed steam and the steam extracted from the high-pressure turbine 3. The steam compression apparatus (steam heat pump) 27 is provided for each of the low-pressure turbines 5A and 5C.

In the same manner as the eighth embodiment, an increase in the power output in this embodiment is made possible by using low-pressure turbines 5A, 5B, and 5C equipped with longer rotor blades than the conventional models and also using the steam generator 57 having a larger heat transfer area than the conventional models.

This embodiment can also obtain all of the effects that can be obtained by the first embodiment.

Eleventh Embodiment

Figure 18:
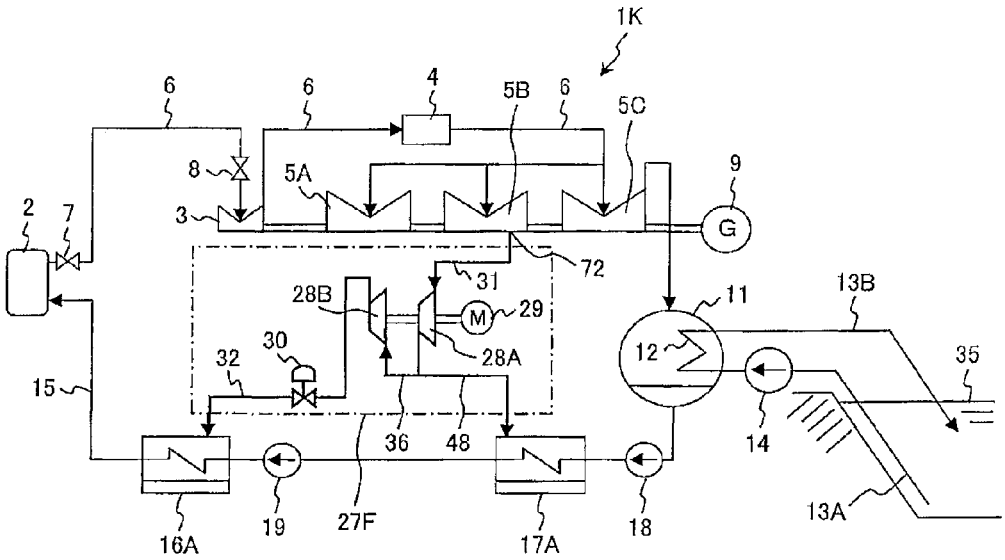
FIG. 18 is a configuration diagram of a BWR nuclear power plant according to an eleventh embodiment that is still another embodiment of the present invention.

An electric power plant according to an eleventh embodiment which is another embodiment of the present invention will be described with reference to FIG. 18. The electric power plant in this embodiment is also an 1100 MWe BWR-5 type BWR nuclear power plant 1K. The BWR nuclear power plant 1K has a configuration in which the steam compression apparatus 27 of the BWR nuclear power plant 1 in the first embodiment is replaced by a steam compression apparatus 27F. The steam feed pipe 31 is connected to the steam extraction point 72. Furthermore, the BWR nuclear power plant 1K is not equipped with the extraction pipe 20 that connects the high-pressure turbine 3 to the first high-pressure feed water heater 16A, the extraction pipe 22 that connects the steam extraction point 71 of the low-pressure turbine 5B to the third low-pressure feed water heater 17A, and the drainage water pipe 26. The other configuration of the BWR nuclear power plant 1K is the same as the configuration of the BWR nuclear power plant 1.

The steam compression apparatus 27F has a configuration in which the steam compressor 28 of the steam compression apparatus 27 is replaced by steam compressors 28A and 28B, and the steam outlet of the steam compressor 28A is connected to the steam inlet of the steam compressor 28B via the pipe 36. The steam compressors 28A and 28B connected in series via the pipe 36 are coupled to the drive apparatus 29 via the common rotational axis. The steam feed pipe 31 connected to the steam extraction point 72 of the low-pressure turbine 5B is connected to the steam inlet of the steam compressor 28A. The steam feed pipe 32 provided with the control valve 30 is connected to the steam outlet of the steam compressor 28B and the first high-pressure feed water heater 16A. A pipe (third pipe) 48 connected to the pipe 36 is connected to the third low-pressure feed water heater 17A. It can also be said that the steam compression apparatus 27F has a configuration in which the pipe 48 that is connected to the third low-pressure feed water heater 17A is provided in addition to the pipe 36 of the steam compression apparatus 27A used in the second embodiment. The steam extraction point 72 to which the extraction pipe 23 is connected and the steam extraction point 72 to which the steam feed pipe 31 is connected are separated from each other in the circumferential direction of the low-pressure turbine 5B at locations on the same stage of the stator blades provided in the low-pressure turbine 5B.

Next, the function of the BWR nuclear power plant 1K will be described with a focus on the steam compression apparatus 27F having a different configuration. The steam extracted from the steam extraction point 72 of the low-pressure turbine 5B is supplied to the steam compressor 28A through the steam feed pipe 31 and compressed with the steam compressor 28A, increasing the steam temperature. The steam compressed with the steam compressor 28A and the temperature of which has been increased is discharged to the pipe 36. A portion of the compressed and temperature-risen steam is supplied to the third low-pressure feed water heater 17A through the pipe 48 and used to heat the feed water in the third low-pressure feed water heater 17A. The remaining steam discharged to the pipe 36 is compressed with the steam compressor 28B, further increasing the steam temperature. The compressed steam discharged from the steam compressor 28B is supplied to the first high-pressure feed water heater 16A through the steam feed pipe 32. This compressed steam heats the feed water in the first high-pressure feed water heater 16A.

In this embodiment, steam extracted from the steam extraction point of the high-pressure turbine 3 is not supplied to the first high-pressure feed water heater 16A, and steam extracted from the steam extraction point 71 of the low-pressure turbine 5B is not supplied to the third low-pressure feed water heater 17A. Therefore, the feed water flowing through the feed water pipe 15 is heated in the first high-pressure feed water heater 16A and the third low-pressure feed water heater 17A only by the compressed steam supplied from the steam compression apparatus 27F. In the sixth low-pressure feed water heater 17D, fifth low-pressure feed water heater 17C, fourth low-pressure feed water heater 17B, and the second high-pressure feed water heater 16B, the feed water is heated by the extracted steam in the same manner as the first embodiment.

The steam compression apparatus (steam heat pump) 27F is also provided for each of the low-pressure turbines 5A and 5C. In the steam compression apparatus 27F provided for the low-pressure turbine 5A, the steam extracted from the steam extraction point 72 of the low-pressure turbine 5A is compressed with the steam compressor 28A and supplied to the third low-pressure feed water heater 17A provided for the low-pressure turbine 5A. The steam compressed by the steam compressor 28B of the steam compression apparatus 27F is supplied to the first high-pressure feed water heater 16A. In the steam compression apparatus 27F provided for the low-pressure turbine 5C, the steam extracted from the steam extraction point 72 of the low-pressure turbine 5C is compressed with the steam compressor 28A and supplied to the third low-pressure feed water heater 17A provided for the low-pressure turbine 5C. The steam compressed by the steam compressor 28B of the steam compression apparatus 27F is supplied to the first high-pressure feed water heater 16A.

In the same manner as the first embodiment, this embodiment also executes operation to increase power output by which the core flow rate is increased so as to increase the nuclear reactor power output to more than the rated power output.

As stated above, in this embodiment provided with the steam compression apparatus 27F, the steam respectively compressed with the steam compressors 28A and 28B and the temperature of which has been increased is supplied to the first high-pressure feed water heater 16A and the third low-pressure feed water heater 17A, and used to heat the feed water. Therefore, the temperature of the feed water supplied to the nuclear reactor 2 is higher than the feed water temperature used in the conventional BWR nuclear power plant. An increase in the feed water temperature will enable the heat generated by nuclear fission in the nuclear reactor 2 to be effectively utilized to generate steam; consequently, it is possible to increase the flow rate of the steam discharged from the nuclear reactor 2. Therefore, thermal efficiency in the BWR nuclear power plant 1 can be increased.

Because the steam compressors 28A and 28B used in this embodiment are smaller than the compressor described in Japanese Utility Model Application Publication No. Hei 1(1989)-123001, the amount of plant service power consumed by the drive apparatus 29 that drives the steam compressors 28A and 28B is smaller than the amount of plant service power consumed when driving the compressor described in Japanese Utility Model Application Publication No. Hei 1(1989)-123001. Therefore, thermal efficiency in the BWR nuclear power plant 1 is further increased.

The thermal efficiency in the BWR nuclear power plant 1 stated above is greater than the thermal efficiency in the BWR nuclear power plant 1 when operation to increase power output is conducted in the BWR nuclear power plant 1.

In this embodiment, because a portion of the compressed steam discharged from the steam compressor 28A is supplied to the third low-pressure feed water heater 17A, the flow rate of the compressed steam supplied to the steam compressor 28B decreases. Therefore, steam compression efficiency in the steam compressor 28B can be increased.

In the same manner as the first embodiment, in this embodiment as well, the temperature of seawater discharged from the condenser 11 decreases, and consequently, the amount of heat discharged to the sea can be reduced.

In this embodiment, instead of connecting the steam feed pipe 31 to a low-pressure turbine, the steam feed pipe 31 may be connected to any one of the high-pressure turbine 3, the moisture separator 4, and the main steam pipe 6 located between the high-pressure turbine 3 and the low-pressure turbine. Instead of connecting the steam feed pipe 32 to the first high-pressure feed water heater 16A, the steam feed pipe 32 may be connected to any one of the second high-pressure feed water heater 16B, third low-pressure feed water heater 17A, fourth low-pressure feed water heater 17B, and the fifth low-pressure feed water heater 17C that is determined corresponding to the location of the main steam system to which the steam feed pipe 31 is connected. The pipe 48 may be connected to any one of the second high-pressure feed water heater 16B, third low-pressure feed water heater 17A, fourth low-pressure feed water heater 17B, and the fifth low-pressure feed water heater 17C, which is located upstream of the feed water heater to that the steam feed pipe 32 is connected.

The steam generating apparatus 27F, the steam feed pipes 31 and 32, and the pipe 48 used in this embodiment may apply to the PWR nuclear power plant to which the eighth embodiment is applied, the FBR nuclear power plant to which the ninth embodiment is applied, and the thermal power plant to which the tenth embodiment is applied.

Twelfth Embodiment

Figure 19:
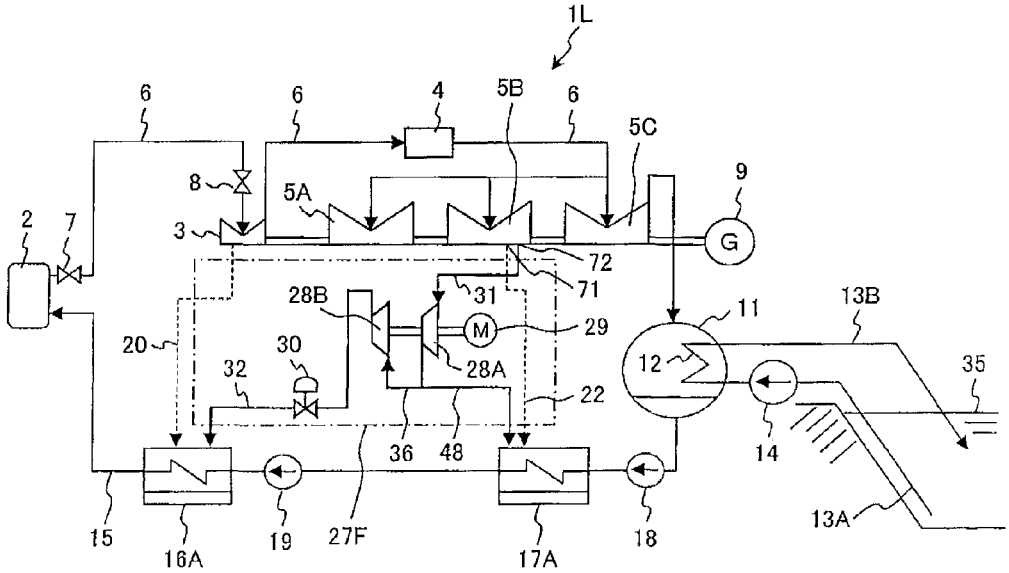
FIG. 19 is a configuration diagram of a BWR nuclear power plant according to a twelfth embodiment that is still another embodiment of the present invention.

An electric power plant according to a twelfth embodiment which is another embodiment of the present invention will be described with reference to FIG. 19. The electric power plant in this embodiment is also an 1100 MWe BWR-5 type BWR nuclear power plant 1L. The BWR nuclear power plant 1L is configured such that: the extraction pipe 20 which connects the steam extraction point (first location) of the high-pressure turbine 3 used in the first embodiment to the first high-pressure feed water heater 16A; the extraction pipe 22 that connects the steam extraction point 71 (third location) of the low-pressure turbine 5B to the third low-pressure feed water heater 17A; and the drainage water pipe 26 that connects the moisture separator 4 to the third low-pressure feed water heater 17A are provided in addition to the configuration of the BWR nuclear power plant 1K of the eleventh embodiment. The other configuration of the BWR nuclear power plant 1L is the same as the configuration of the BWR nuclear power plant 1K. The steam feed pipe 31 is connected to the steam extraction point 72 (second location) of the low-pressure turbine 5B.

In this embodiment, in the third low-pressure feed water heater 17A, the feed water is heated by the steam compressed with the steam compressor 28A, the drainage water supplied from the drainage water pipe 26, and the steam extracted from the low-pressure turbine 5B and supplied from the extraction pipe (fourth pipe) 22. In the first high-pressure feed water heater 16A, the feed water is heated by the steam compressed with the steam compressors 28A and 28B and the steam extracted from the high-pressure turbine 3 and supplied from the extraction pipe 20.

This embodiment can obtain all of the effects that can be obtained by the eleventh embodiment. Furthermore, in this embodiment, because in the first high-pressure feed water heater 16A and the third low-pressure feed water heater 17A, the feed water is heated by both the extracted steam and the compressed steam, the temperature increase ratio of the steam compressed with the steam compressors 28A and 28B can be made smaller than the temperature increase ratio of the steam compressed with the compressor described in Japanese Utility Model Application Publication No. Hei 1(1989)-123001. Therefore, the amount of plant service power consumed by the drive apparatus 29 that drives the steam compressors 28A and 28B can be made smaller than the amount of electric power consumed by driving the compressor described in Japanese Utility Model Application Publication No. Hei 1(1989)-123001. Consequently, it is possible to further increase the thermal efficiency in the BWR nuclear power plant 1L.

INDUSTRIAL APPLICABILITY OF THE INVENTION

The present invention can apply to electric power plants, such as nuclear power plants including BWR nuclear power plants, PWR nuclear power plants, and the like, and thermal power plants.

The invention claimed is:

1. An electric power plant, comprising:

a steam generator for generating steam;

a main steam system equipped with a main steam pipe connected to the steam generator and directing the steam, a first turbine to which the steam is sequentially supplied from the main steam pipe, and a second turbine having a lower pressure than the first turbine;

a condenser for condensing the steam discharged from the second turbine;

a feed water pipe for directing feed water generated by condensing the steam with the condenser to the steam generating apparatus;

a feed water heater provided for the feed water pipe; a steam compressor for compressing the steam;

a first pipe not equipped with a steam compressor and directing the steam extracted from a first location of the main steam system to the feed water heater; and a second pipe equipped with the steam compressor and directing the steam discharged from a second location of the main steam system located downstream of the first location to the feed water heater to which the first pipe is connected.

2. The electric power plant according to claim 1, wherein the steam compressor is connected to the second pipe and compressing the steam and a driver for driving the steam compressor.

3. The electric power plant according to claim 1, wherein:

the steam compressor is a plurality of steam compressors for compressing the steam and a driver for driving the plurality of steam compressors; and the plurality of steam compressors is connected to the second pipe in parallel.

4. The electric power plant according to claim 1, wherein:

the steam compressor is a plurality of steam compressors for compressing the steam and a driver for driving the plurality of steam compressors; and the plurality of steam compressors are connected to the second pipe in series so that the steam is supplied sequentially.

5. The electric power plant according to claim 2, wherein the driver is an electric motor.

6. The electric power plant according to claim 3, wherein the driver is a turbine driven by the steam generated in the steam generator.

7. The electric power plant according to claim 1, wherein the electric power plant is a nuclear power plant or a thermal power plant.

8. A method for running an electric power plant, comprising steps of:

sequentially supplying steam generated in a steam generator to a first turbine and a second turbine having a lower pressure than the first turbine through a main steam pipe;

generating feed water by condensing the steam discharged from the second turbine with a condenser;

supplying the feed water to the steam generator through a feed water pipe equipped with a feed water heater;

supplying the steam extracted from a first location of a main steam system including the main steam pipe, the first turbine, and the second turbine to the feed water heater without the steam passing through a steam compressor;

compressing the steam discharged from a second location of the main steam system located downstream of the first location with the steam compressor and supplying the compressed steam to the feed water heater to which the steam extracted from the first location is supplied; and heating the feed water in the feed water heater by the steam extracted from the first location and the steam compressed with the steam compressor.

9. The method for running an electric power plant according to claim 8, wherein:

compression of the steam with the steam compressor is executed such that one steam compressor included in the steam compressor is driven with a driver; and the steam is compressed with the steam compressor.

10. The method for running an electric power plant according to claim 8, wherein:

compression of the steam with the steam compressor is executed such that a plurality of steam compressors included in the steam compressor are driven with a driver; and the steam is compressed in parallel with the plurality of steam compressors.

11. The method for running an electric power plant according to claim 8, wherein:

compression of the steam with the steam compressor is executed such that a plurality of steam compressors included in the steam compressor are driven with a driver; and the steam is sequentially supplied to the plurality of steam compressors and compressed therewith.

12. The method for running an electric power plant according to claim 8, wherein the electric power plant is a nuclear power plant or a thermal power plant.

13. An electric power plant, comprising:

a steam generator for generating steam;

a main steam system equipped with a main steam pipe connected to the steam generator and directing the steam, a first turbine to which the steam is sequentially supplied from the main steam pipe, and a second turbine having a lower pressure than the first turbine;

a condenser for condensing the steam discharged from the second turbine;

a feed water pipe for directing feed water generated by condensing the steam with the condenser to the steam generator;

a plurality of feed water heaters provided for the feed water pipe;

a first steam compressor and a second steam compressor driven with a driver and sequentially compressing the steam;

a first pipe provided with the first and the second steam compressors in series and directing the steam extracted from a certain location of the main steam system to one of the feed water heaters; and a second pipe for directing a portion of the steam discharged from the first steam compressor, of the first and the second steam compressors, located upstream of flow of the steam to another one of the feed water heaters located upstream of said one of the feed water heaters.

14. An electric power plant, comprising:

a steam generator for generating steam;

a main steam system equipped with a main steam pipe connected to the steam generator and directing the steam, a first turbine to which the steam is sequentially supplied from the main steam pipe, and a second turbine having a lower pressure than the first turbine;

a condenser for condensing the steam discharged from the second turbine;

a feed water pipe for directing feed water generated by condensing the steam with the condenser to the steam generator;

a plurality of feed water heaters provided for the feed water pipe;

a first steam compressor and a second steam compressor driven with a driver and sequentially compressing the steam;

a third pipe not equipped with a steam compressor and directing the steam extracted from a first location of the main steam system to one of the feed water heaters;

a first pipe equipped with the first and the second steam compressors in series and directing the steam discharged from a second location of the main steam system located downstream of the first location to said one of the feed water heaters;

a second pipe for directing a portion of the steam discharged from the first steam compressor, of the first and the second steam compressors, located upstream of flow of the steam to another one of the feed water heaters located upstream of said one of the feed water heaters; and a fourth pipe not equipped with a steam compressor and directing the steam discharged from a third location of the main steam system located between the first location and the second location to said another one of the feed water heaters.

15. The electric power plant according to claim 13, wherein the electric power plant is a nuclear power plant or a thermal power plant.

16. A method for running an electric power plant, comprising steps of:

sequentially supplying steam generated in a steam generator to a first turbine and a second turbine having a lower pressure than the first turbine through a main steam pipe;

generating feed water by condensing the steam discharged from the second turbine with a condenser;

supplying the feed water to the steam generator through a feed water pipe provided with a plurality of feed water heaters;

sequentially compressing the steam extracted from a certain location of a main steam system including the main steam pipe, the first turbine, and the second turbine with a first steam compressor and a second steam compressor driven with a driver, supplying the steam to one of the feed water heaters, and heating the feed water supplied to said one of the feed water heaters by the steam; and supplying a portion of the steam discharged from the first steam compressor, of the first and the second steam compressors, located upstream of flow of the steam to another one of the feed water heaters located upstream of said one of the feed water heaters, and heating the feed water supplied to said another one of the feed water heaters by the steam.

17. A method for running an electric power plant, comprising steps of:

sequentially supplying steam generated in a steam generator to a first turbine and a second turbine having a lower pressure than the first turbine through a main steam pipe;

generating feed water by condensing the steam discharged from the second turbine with a condenser;

supplying the feed water to the steam generator through a feed water pipe provided with a plurality of feed water heaters;

supplying the steam extracted from a first location of a main steam system including the main steam pipe, the first turbine, and the second turbine to one of the feed water heaters without the steam passing through a steam compressor;

compressing the steam discharged from a second location of the main steam system located downstream of the first location with the first and the second steam compressors driven with a driver and supplying the steam to said one of the feed water heaters;

heating the feed water in said one of the feed water heaters by the steam extracted from the first location and the steam compressed with the first and the second steam compressors;

supplying a portion of the steam discharged from the first steam compressor, of the first and the second steam compressors, located upstream of flow of the steam to another one of the feed water heaters located upstream of said one of the feed water heaters;

supplying the steam discharged from a third location of the main steam system located between the first location and the second location to said another one of the feed water heaters without the steam passing through a steam compressor; and heating the feed water in said another one of the feed water heaters by a portion of the steam discharged from the first steam compressor and the steam discharged from the third location.

18. The electric power plant according to claim 14, wherein the electric power plant is a nuclear power plant or a thermal power plant.

* * * * *